US011161678B2

(12) United States Patent
Barfoot et al.

(10) Patent No.: US 11,161,678 B2
(45) Date of Patent: Nov. 2, 2021

(54) PORTABLE STORAGE CONTAINER

(71) Applicant: Otter Products, LLC, Fort Collins, CO (US)

(72) Inventors: Grady E. Barfoot, Denver, CO (US); W. Travis Smith, Fort Collins, CO (US); Michael A. Meuse, Longmont, CO (US); Todd Eichinger, Fort Collins, CO (US); Joshua R. Cornish, Fort Collins, CO (US)

(73) Assignee: Otter Products, LLC, Fort Collins, CO (US)

( * ) Notice: Subject to any disclaimer, the term of this patent is extended or adjusted under 35 U.S.C. 154(b) by 117 days.

(21) Appl. No.: 16/684,317

(22) Filed: Nov. 14, 2019

(65) Prior Publication Data

US 2020/0165055 A1 May 28, 2020

Related U.S. Application Data

(60) Provisional application No. 62/794,378, filed on Jan. 18, 2019, provisional application No. 62/771,991, filed on Nov. 27, 2018.

(51) Int. Cl.
*B65D 81/38* (2006.01)
*B65D 43/02* (2006.01)
(Continued)

(52) U.S. Cl.
CPC ..... *B65D 81/3818* (2013.01); *B65D 21/0209* (2013.01); *B65D 25/2888* (2013.01);
(Continued)

(58) Field of Classification Search
CPC ..... B65D 51/04; B65D 43/161; B65D 2251/1008; B65D 2251/101;
(Continued)

(56) References Cited

U.S. PATENT DOCUMENTS 1,468,563 A 9/1923 Girard
2,627,993 A 2/1953 Hafner
(Continued)

FOREIGN PATENT DOCUMENTS

EP 3061704 A1 8/2016
WO 2004029526 A1 4/2004
(Continued)

OTHER PUBLICATIONS

U.S. Appl. No. 16/566,191, filed Sep. 10, 2019, Jonathan H. Guerdrum.
(Continued)

*Primary Examiner* — Andrew T Kirsch

(57) ABSTRACT

A portable storage container includes a body and a lid. The body has a bottom and sides that define an interior storage volume. The lid is attachable to the body for closing the interior storage volume and includes a lid base, a first lid member, and a second lid member. The first lid member is hingeably attached to the lid base on a first side and the second lid member is hingeably attached on a second side. Each of the lid members includes a handle recess and an attached handle. The handle of the first lid member is positioned at least partially in the handle recess of the second lid member and the handle of the second lid member is positioned at least partially in the handle recess of the first lid member when the first lid member opened and the second lid member is closed.

19 Claims, 35 Drawing Sheets

(51) Int. Cl.

| | |
|---|---|
| ***B65D 25/28*** | (2006.01) |
| ***B65D 43/16*** | (2006.01) |
| ***B65D 51/24*** | (2006.01) |
| ***B65D 21/02*** | (2006.01) |

(52) U.S. Cl.
CPC ..... *B65D 43/0214* (2013.01); *B65D 43/164* (2013.01); *B65D 51/242* (2013.01); *B65D 81/3816* (2013.01)

(58) Field of Classification Search
CPC .... B65D 2251/1023; B65D 2251/1055; B65D 2251/1058; B65D 2543/00379; A45C 11/20
See application file for complete search history.

(56) References Cited

U.S. PATENT DOCUMENTS 3,347,060 A 10/1967 Barkan
3,395,550 A 8/1968 Dungan
3,658,035 A 4/1972 Harris
3,850,398 A 11/1974 Kantor
3,868,829 A 3/1975 Mann et al.
3,939,986 A 2/1976 Pierro
4,024,731 A 5/1977 Branscum
4,143,695 A * 3/1979 Hoehn ..... A45C 11/20 220/215
4,213,310 A 7/1980 Buss
D275,822 S 10/1984 Gatland et al.
4,515,421 A 5/1985 Steffes
4,560,128 A 12/1985 Willeby et al.
4,606,461 A 8/1986 Bolton
RE32,740 E 8/1988 Steffes
4,841,661 A 6/1989 Moore
4,964,528 A 10/1990 Wagoner
4,988,216 A 1/1991 Lyman
5,052,185 A 10/1991 Spahr
D325,323 S 4/1992 Kahl
5,103,884 A 4/1992 Roman
D327,427 S 6/1992 McCooey
D328,389 S 8/1992 Pardo
D330,488 S 10/1992 Daniels
5,181,612 A 1/1993 Liu
5,215,248 A 6/1993 Moser
5,285,656 A 2/1994 Peters
D353,082 S 12/1994 Keven
D354,419 S 1/1995 Kahl et al.
5,403,095 A 4/1995 Melk
5,447,041 A * 9/1995 Piechota ..... A45C 11/20 206/542
5,509,279 A 4/1996 Brown et al.
5,562,228 A 10/1996 Ericson
5,605,056 A 2/1997 Brown et al.
5,622,276 A 4/1997 Simmons
5,669,233 A 9/1997 Cook et al.
D387,249 S 12/1997 Mogil
D391,121 S 2/1998 Melk
5,816,432 A 10/1998 Hammen et al.
5,845,515 A 12/1998 Nelson
5,850,915 A 12/1998 Tajima
5,857,778 A 1/1999 Ells
5,913,448 A 6/1999 Mann et al.
D419,297 S 1/2000 Richardson et al.
D419,767 S 2/2000 Richardson et al.
D419,768 S 2/2000 Richardson et al.
6,039,202 A 3/2000 Olstad et al.
D425,761 S 5/2000 Philipson et al.
6,065,873 A 5/2000 Fowler
D435,196 S 12/2000 Gregor et al.
6,185,860 B1 2/2001 Thibodeaux
6,193,097 B1 2/2001 Perianes
D441,261 S 5/2001 Stein
6,234,677 B1 5/2001 Mogil
6,244,458 B1 * 6/2001 Frysinger ..... B65D 81/3823 220/592.09
D444,683 S 7/2001 Corrion
6,276,579 B1 8/2001 DeLoach
D451,765 S 12/2001 Israel et al.
6,325,281 B1 12/2001 Grogan
6,328,179 B1 12/2001 Conrado et al.
D455,934 S 4/2002 Culp et al.
6,409,066 B1 6/2002 Schneider et al.
D465,134 S 11/2002 Joss
6,474,095 B1 11/2002 Chan
D469,012 S 1/2003 Lee
6,505,479 B2 1/2003 Defelice et al.
D472,384 S 4/2003 Richardson
6,595,687 B2 7/2003 Godshaw et al.
6,736,309 B1 5/2004 Westerman et al.
6,751,963 B2 6/2004 Navedo et al.
D502,599 S 3/2005 Cabana et al.
6,895,778 B1 5/2005 Ackerman
D513,122 S 12/2005 Greene
D513,123 S 12/2005 Richardson et al.
D514,808 S 2/2006 Morine et al.
6,993,931 B1 2/2006 Hamilton
D516,807 S 3/2006 Richardson et al.
D527,226 S 8/2006 Maldonado
D527,953 S 9/2006 Gal
7,140,507 B2 11/2006 Maldonado et al.
D543,030 S * 5/2007 Schafer ..... D3/272
7,257,963 B2 8/2007 Mayer
D553,999 S 10/2007 Mason
7,296,433 B2 11/2007 Uihlein et al.
D558,599 S 1/2008 Tilman et al.
D569,902 S 5/2008 Chang et al.
7,389,608 B1 6/2008 MacKay
7,415,794 B1 8/2008 Thompson
7,422,143 B2 9/2008 Mayer
7,682,080 B2 3/2010 Mogil
D623,075 S 9/2010 Blythe
D623,947 S 9/2010 Levy
7,791,003 B2 9/2010 Lockhart et al.
7,900,816 B2 3/2011 Kastanek et al.
7,908,870 B2 3/2011 Williams et al.
D635,832 S 4/2011 Bergin
D637,044 S 5/2011 Davis
7,950,246 B1 5/2011 Mayer et al.
D643,629 S 8/2011 Sofy et al.
8,011,194 B2 9/2011 Dimmitt
8,043,004 B2 10/2011 Mogil
D649,587 S 11/2011 Nemeth et al.
8,065,889 B1 11/2011 Silberman
D659,014 S 5/2012 Blythe
8,209,995 B2 7/2012 Kieling et al.
8,246,190 B2 8/2012 Boiteau et al.
8,317,046 B2 11/2012 Vanderberg et al.
8,365,944 B2 2/2013 Vanderberg et al.
8,403,162 B2 3/2013 Vanderberg et al.
8,424,699 B2 4/2013 Vanderberg et al.
8,430,265 B2 4/2013 Vanderberg et al.
8,448,813 B2 5/2013 Vanderberg et al.
8,607,581 B2 12/2013 Williams et al.
D697,770 S 1/2014 Khuu
D699,119 S 2/2014 Fukuda et al.
D712,720 S 9/2014 Seiders
D712,721 S 9/2014 Seiders
D712,722 S 9/2014 Seiders
D712,723 S 9/2014 Seiders
D714,125 S 9/2014 Seiders
8,863,546 B2 10/2014 Oberweis
8,875,964 B1 11/2014 Vanderberg
8,910,819 B2 12/2014 Seiders
8,919,082 B1 12/2014 Cataldo
8,925,752 B2 1/2015 Smith
D722,474 S 2/2015 Seiders
D722,475 S 2/2015 Seiders
D726,816 S 4/2015 Ehrlich et al.
9,022,249 B2 5/2015 Ranade
D730,649 S 6/2015 Thomas
D732,348 S 6/2015 Seiders et al.
D732,350 S 6/2015 Seiders et al.
D732,899 S 6/2015 Seiders et al.
9,139,352 B2 9/2015 Seiders et al.

(56) References Cited

U.S. PATENT DOCUMENTS

| | | | |
|---|---|---|---|
| 9,187,232 | B2 | 11/2015 | Seiders |
| D748,978 | S | 2/2016 | Glass et al. |
| D752,347 | S | 3/2016 | Seiders et al. |
| 9,316,428 | B2 | 4/2016 | Mech |
| D757,534 | S | 5/2016 | Matsuura |
| 9,389,010 | B1 | 7/2016 | Booker |
| 9,408,445 | B2 | 8/2016 | Mogil et al. |
| 9,433,200 | B2 | 9/2016 | Norman |
| 9,446,847 | B2 | 9/2016 | Richardson et al. |
| 9,500,400 | B2 | 11/2016 | Smith |
| D778,614 | S | 2/2017 | Ananian et al. |
| 9,834,342 | B2 | 4/2017 | Seiders |
| D785,334 | S | 5/2017 | Holt et al. |
| D786,559 | S | 5/2017 | Seiders et al. |
| D786,560 | S | 5/2017 | Seiders et al. |
| D786,561 | S | 5/2017 | Seiders et al. |
| D786,562 | S | 5/2017 | Seiders et al. |
| D787,187 | S | 5/2017 | Seiders et al. |
| D797,454 | S | 9/2017 | Seiders et al. |
| D797,455 | S | 9/2017 | Seiders et al. |
| 9,751,682 | B2 | 9/2017 | Mayer et al. |
| D798,670 | S | 10/2017 | Seiders et al. |
| D799,276 | S | 10/2017 | Seiders et al. |
| D799,277 | S | 10/2017 | Seiders et al. |
| D799,905 | S | 10/2017 | Seiders et al. |
| D801,123 | S | 10/2017 | Seiders et al. |
| 9,796,517 | B2 | 10/2017 | Seiders et al. |
| D802,373 | S | 11/2017 | Seiders et al. |
| D803,041 | S | 11/2017 | Patterson |
| D804,905 | S | 12/2017 | Seiders et al. |
| D805,851 | S | 12/2017 | Seiders et al. |
| D820,646 | S | 6/2018 | Yockey |
| D821,165 | S | 6/2018 | Guerdrum et al. |
| D821,825 | S | 7/2018 | Sullivan et al. |
| D823,064 | S | 7/2018 | Eichinger et al. |
| D823,065 | S | 7/2018 | Eichinger et al. |
| D823,066 | S | 7/2018 | Eichinger et al. |
| 10,029,842 | B2 | 7/2018 | Seiders et al. |
| D824,730 | S | 8/2018 | Guerdrum et al. |
| 10,046,900 | B2 | 8/2018 | Seiders |
| D828,029 | S | 9/2018 | Seiders et al. |
| 10,092,137 | B1 | 10/2018 | Nelson et al. |
| D835,470 | S | 12/2018 | Seiders et al. |
| D835,471 | S | 12/2018 | Seiders et al. |
| D835,472 | S | 12/2018 | Seiders et al. |
| D835,946 | S | 12/2018 | Seiders et al. |
| D838,983 | S | 1/2019 | Seiders et al. |
| D838,984 | S | 1/2019 | Seiders et al. |
| D840,150 | S | 2/2019 | Seiders et al. |
| 10,221,005 | B2 | 3/2019 | James |
| D845,717 | S | 4/2019 | Cavenagh et al. |
| D850,865 | S | 6/2019 | Smith et al. |
| 10,351,330 | B2 | 7/2019 | Smith et al. |
| D856,673 | S | 8/2019 | Stirnimann et al. |
| 10,392,180 | B1 | 8/2019 | Travis et al. |
| 10,443,918 | B2 | 10/2019 | Li et al. |
| 2003/0038138 | A1 | 2/2003 | Komurke |
| 2003/0106895 | A1 | 6/2003 | Kalal |
| 2003/0136702 | A1 | 7/2003 | Redzisz et al. |
| 2003/0141424 | A1 | 7/2003 | Thomas |
| 2004/0178208 | A1 | 9/2004 | Leba et al. |
| 2004/0238543 | A1 | 12/2004 | Askew |
| 2004/0262319 | A1 | 12/2004 | Fisher |
| 2005/0006268 | A1 | 1/2005 | Futernick |
| 2005/0133557 | A1 | 6/2005 | McKenzie et al. |
| 2005/0263527 | A1 | 12/2005 | Maldonado et al. |
| 2005/0263528 | A1 | 12/2005 | Maldonado et al. |
| 2005/0279123 | A1 | 12/2005 | Maldonado et al. |
| 2005/0279124 | A1 | 12/2005 | Maldonado |
| 2005/0281487 | A1 | 12/2005 | Pawloski et al. |
| 2006/0065655 | A1 | 3/2006 | Taylor |
| 2006/0180624 | A1 | 8/2006 | Sadow et al. |
| 2007/0137958 | A1 | 6/2007 | Hamlin |
| 2007/0278234 | A1 | 12/2007 | Mogil |
| 2008/0094853 | A1 | 4/2008 | Kim et al. |
| 2008/0257918 | A1* | 10/2008 | Vogel ..... B65D 47/0895 222/480 |
| 2008/0260303 | A1 | 10/2008 | Lesseux et al. |
| 2009/0159471 | A1 | 6/2009 | Koppe |
| 2009/0218342 | A1 | 9/2009 | Pickles |
| 2010/0001018 | A1* | 1/2010 | Puma ..... B65D 47/242 222/1 |
| 2010/0065466 | A1 | 3/2010 | Perkins |
| 2010/0072215 | A1 | 3/2010 | Coon |
| 2010/0287976 | A1 | 11/2010 | Roof et al. |
| 2011/0056233 | A1 | 3/2011 | Flaker et al. |
| 2011/0182532 | A1 | 7/2011 | Baltus |
| 2011/0203297 | A1 | 8/2011 | Oberweis |
| 2011/0220531 | A1 | 9/2011 | Meether et al. |
| 2011/0289958 | A1 | 12/2011 | White et al. |
| 2013/0228583 | A1 | 9/2013 | Mayer |
| 2013/0264161 | A1 | 10/2013 | Thompson |
| 2014/0013789 | A1 | 1/2014 | Conrad et al. |
| 2014/0054195 | A1 | 2/2014 | Hallman |
| 2014/0131225 | A1 | 5/2014 | Couch, I et al. |
| 2014/0248003 | A1 | 9/2014 | Mogil et al. |
| 2015/0158539 | A1 | 6/2015 | Jensen et al. |
| 2015/0210444 | A1 | 7/2015 | Mercado et al. |
| 2015/0241107 | A1 | 8/2015 | Mech |
| 2015/0298886 | A1 | 10/2015 | Knight et al. |
| 2015/0369529 | A1 | 12/2015 | Monroe |
| 2016/0101924 | A1 | 4/2016 | Mitchell et al. |
| 2016/0257471 | A1 | 9/2016 | Rud |
| 2016/0257479 | A1 | 9/2016 | Seiders et al. |
| 2016/0279840 | A1 | 9/2016 | French et al. |
| 2016/0347507 | A1 | 12/2016 | Kendrick |
| 2017/0001785 | A1 | 1/2017 | Ripley et al. |
| 2017/0023289 | A1 | 1/2017 | Anderson |
| 2017/0073146 | A1 | 3/2017 | Kuhn et al. |
| 2017/0073147 | A1 | 3/2017 | Kuhn |
| 2017/0121059 | A1 | 5/2017 | Faris |
| 2017/0233139 | A1 | 8/2017 | Averill |
| 2017/0245486 | A1 | 8/2017 | Larson et al. |
| 2017/0305639 | A1 | 10/2017 | Kuhn et al. |
| 2017/0350635 | A1 | 12/2017 | Thirumurugavel |
| 2018/0015938 | A1 | 1/2018 | DeFrancia |
| 2018/0141718 | A1 | 5/2018 | Ahlström et al. |
| 2018/0149400 | A1 | 5/2018 | Valencia |
| 2018/0184775 | A1 | 7/2018 | Altschul et al. |
| 2018/0186547 | A1 | 7/2018 | Morine et al. |
| 2018/0186550 | A1 | 7/2018 | Morine et al. |
| 2018/0202700 | A1 | 7/2018 | Ansted et al. |
| 2018/0263346 | A1 | 9/2018 | Stephens |
| 2018/0290814 | A1 | 10/2018 | Smith |
| 2018/0335241 | A1 | 11/2018 | Li et al. |
| 2018/0346229 | A1 | 12/2018 | Guerdrum et al. |
| 2018/0353379 | A1 | 12/2018 | Chou et al. |
| 2019/0023480 | A1 | 1/2019 | Lin |
| 2020/0102126 | A1 | 4/2020 | Guerdrum et al. |

FOREIGN PATENT DOCUMENTS

| | | | |
|---|---|---|---|
| WO | 2006007266 | A2 | 1/2006 |
| WO | 2006009537 | A1 | 1/2006 |
| WO | 2014105962 | A1 | 7/2014 |
| WO | 2016154105 | A1 | 9/2016 |

OTHER PUBLICATIONS amazon.com, "Farberware 5190590 3-piece cutting board set," dated Jul. 23, 2011, downloaded from https ://www.amazon.com/Farberware-5190590-3-Piece-Plastic-Assorted/dp/80731KDNM P/ref=cm_cr_arp d_product_top?ie=UTF8 Mar. 11, 2019, 8 pages.

Best Buy, "OtterBox Separator for Venture Coolers—Slate Gray," downloaded from https://www.bestbuy.com/site/otterbox-separator-for-venture-coolers-slate-gray/5824901.p?sku Id=5824901 Nov. 4, 2018, 5 pages.

Best Cooler Reviews, Best Folding and Collapsible Cooler—It's All About Convenience, downloaded from https://bestcooler.reviews/best-folding-collapsible-cooler/ Jan. 15, 2018, 8 pages.

Clevermade, CleverMade CleverCrates 45 Liter Collapsible Storage Bin/Container; Grated Wall Utility Basket/Tote, Royal Blue, down-

(56) References Cited

OTHER PUBLICATIONS loaded from https://www.amazon.com/CleverMade-CleverCrates-Collapsible-Storage-Container/dp/B00UM4D63W/ref=sr_1_8?ie=UTF8&qid=1516048768&sr=8-8&keywords=collapsible%2Bmilk%2Bcrate&th=1 Jan. 15, 2018, 13 pages.
Coleman, 75 Can Collapsible Sport Cooler, downloaded from https://www.coleman.com/large-sport-collapsible/2000015225.html Jan. 15, 2018, 3 pages.
Digital Trends, "The new Venture coolers from Otterbox . . . ", Posted May 9, 2017.(https://www.digitaltrends.com/outdoors/otterbox-venture-coolers/).
Duluth Trading Co, Folding Milk Crate, downloaded from https://www.duluthtrading.com/store/product/folding-milk-crate-78536.aspx on Jan. 15, 2018, 6 pages.
Fulton, Wil, All the Major Meal Delivery Services, Tested and Ranked, dated Oct. 7, 2016, downloaded from https://www.thrillist.com/eat/nation/best-meal-delivery-services-food-subscription-boxes-ranked on Jan. 15, 2018, 18 pages.
Ice Chest Guide, "Top 10 Best Soft Cooler Reviews and Buying Guide for 2018", downloaded from http://www.icechestguide.com/top-10-best-soft-cooler-reviews-and-buying-guide.html Jan. 25, 2018, 12 pages.
Igloo, Marine Ultra TM Collapse and Cool TM 50, downloaded from https://www.igloocoolers.com/products/61582-marine-ultra-collapse-and-cool-50-can-cooler-bag-white Jan. 15, 2018, 4 pages.
KELTY Folding Cooler, downloaded from https://www.kelty.com/folding-cooler/ Jan. 18, 2018, 6 pages.
Morris, David Z., This box opens up new possibilities for fresh food delivery, dated Aug. 3, 2015, downloaded from http://fortune.com/2015/08/03/freshrealm-cold-delivery/ Jan. 15, 2018, 4 pages.
NRS, "NRS Big Sky Cooler Divider at nrs.com," downloaded from https://www.nrs.com/product/4450/nrs-big-sky-cooler-divider Nov. 4, 2018, 4 pages.
Otterbox, "Cooler Divider OtterBox Venture Cooler Accessory," downloaded from www.otterbox.com/en-us/venture/separator/otr56-cooler-acc-separator. html#start= 1 Nov. 4, 2018, 4 pages.
Otterbox, "Rugged Venture Coolers", Accessed Jan. 16, 2018. (https://www.otterbox.com/en-us/venture-coolers.html).
Pelican Consumer, Coolers—Hunting, Fishing, Camping, downloaded from http://www.pelican.com/us/en/products/coolers May 8, 2017, 2 pages.
Pelican Products, "70QT Cooler", Accessed Jan. 16, 2018. (http://www.pelican.com/us/en/product/outdoor-heavy-dutycoolers/elite-cooler/cooler/70QT/).
Picnic at Ascot, 396-RB 60 Can Collapsible Rolling Cooler, downloaded from http://www.picnicatascot.com/maind/default/ProductsDetail.aspx?id=136 Jan. 15, 2018, 2 pages.
Polar Bear Coolers, "24 Pack Eclipse Cooler," downloaded from http://www.polarbearcoolers.com/product/PB327.html Jan. 30, 2018, 6 pages.
Polar Bear Coolers, "Eclipse Backpack Cooler," downloaded from http://www.polarbearcoolers.com/product/PB397.html Jan. 29, 2018, 4 pages.
REI Co-Op, "Soft-sided Coolers", downloaded from https://www.rei.com/c/soft-sided-coolers?r-c&origin+web&ir=category%3Asoft-sided-coolers%page=1 Jan. 25, 2018, 6 pages.
RTIC, "RTIC Soft Pack Coolers," downloaded form https://www.rticcoolers.com/shop/coolers/softpak Jan. 25, 2018, 16 pages.
RTIC, Cooler Accessories, downloaded May 8, 2017 from http://www.rticcoolers.com/shop/coolers/accessories, 14 pages.
Stay Cool Hot Stuff, Flip-Box XL Collapsible Cooler and Insulation Box, downloaded from https://staycoolhotstuff.com/products/flip-box-xl-collapsible-cooler-and-insulation-box Jan. 18, 2018, 5 pages.
The Cooler Box, "Cordova Coolers vs Yeti—Is This New Cooler Better Than Yeti?", Published Oct. 24, 2016.(http://thecoolerbox.com/cordova-coolers-vs-yeti/).
The Good Housekeeping Institute, Thermos Cold N' Fold Cooler, dated Jul. 2007, downloaded from http://www.goodhousekeeping.com/travel-products/food-cooler-reviews/a28866/thermos-cold-n-fold-cooler-101/ Jan. 18, 2018, 5 pages.
Walmart, ECR4Kids Large Vented Collapsible Crate, 12pk, downloaded from https://www.walmart.com/ip/ECR4Kids-Large-Vented-Collapsible-Crate-12pk/34702630 on Jan. 15, 2018, 7 pages.
Yeti Coolers, "Hopper Soft Sided Portable Coolers," downloaded from https://www.yeti.com/soft-coolers Jan. 25, 2018, 6 pages.
Yeti Coolers, "Tundra Cooler Divider," dated Mar. 11, 2014, downloaded from https://www.yeti.com/en_US/accessories/tundra-dividers/DV.html?cg id =accessories# Mar. 11, 2019, 9 pages.
Yeti Coolers, Tundra Cooler Divider, downloaded from www.yeti.com/tundra-dividers May 8, 2017, 4 pages.
Yeti Coolers, Tundra Ice Chests, downloaded from http://yeti.com/tundra May 8, 2017, 7 pages.
Yeti Coolers, Yeti Accessories & Parts, downloaded from http://yeti.com/accessories May 8, 2017, 5 pages.

* cited by examiner

PORTABLE STORAGE CONTAINER

CROSS REFERENCE TO RELATED APPLICATIONS

This application claims priority to U.S. Provisional Patent Application No. 62/794,378, filed Jan. 18, 2019, and U.S. Provisional Patent Application No. 62/771,991, filed Nov. 27, 2018, all of which are hereby incorporated by reference in their entireties.

FIELD

This disclosure relates generally to an insulated portable storage container for storing objects, such as food and/or beverages.

BACKGROUND

It is often desirable to bring along food or beverages when traveling or when participating in remote leisure activities. Often, the food may be perishable and the ambient temperature may be high (for instance, at a beach location), so it is desirable to keep the perishable food in a temperature controlled environment to avoid spoiling. Meal delivery kits including perishable items may be assembled and delivered to customers, either through an in-person delivery service or through a shipping service. Portable storage containers, including insulated and non-insulated storage containers, coolers, and/or insulated shipping containers, may also be used for a variety of other purposes or activities including hunting, fishing, camping, medical purposes, general storage, grocery delivery, meal kit shipping, other food delivery, and/or other business or personal purposes. Exemplary portable storage containers are disclosed in U.S. application Ser. No. 15/398,468, filed Jan. 4, 2017; Ser. No. 15/494,020, filed Apr. 21, 2017; Ser. No. 15/935,228, filed Mar. 26, 2018; Ser. No. 15/982,059, filed May 17, 2018; and Ser. No. 15/982,246, filed May 17, 2018, the disclosures of each of which are hereby incorporated by reference in their entirety.

During loading or unloading items, such as food and beverage items, from the insulated portable storage container, temperature control may be disrupted due to extended time with which a lid is not covering the portable storage container. In addition, it may be relatively difficult or take a relatively long amount of time to access an interior of the insulated portable storage container due to the presence of a lid. Moreover, the presence of bulky insulation in one or more sides, bottom, or lid of the insulated portable storage container may reduce the available volume in the interior of the portable storage container.

Improvements in one or more of the foregoing are desired.

SUMMARY

Portable storage containers are used for a variety of purposes and in conjunction with a variety of activities. The storage container may be insulated to assist in keeping one or more items cool, cold, frozen, warm, or hot. The storage container may also be used to protect one or more items from damage, bumps, scratching, impact, water, rain, snow, mud, dust, dirt, light, visibility, theft, chemicals, and/or contaminants. The storage container may also be used to organize and/or transport items stored therein. While most of the examples discussed herein are illustrated with respect to an insulated tote, it should be understood that the techniques and features disclosed herein are applicable to other types of storage containers or temperature control containers. Further, containers of the type disclosed herein may be used for storage or transportation purposes. The containers disclosed herein may be configured to be carried or transported in a plurality of ways or configurations.

In one exemplary embodiment, a portable insulated storage container is provided. The storage container includes a body and a lid removably attached thereto. The body includes a bottom and plurality of sides extending from the bottom, the bottom and plurality of sides defining an interior. The lid includes a first panel hingeably attached to a second panel about a hinge pivot rod configured to be received in a groove formed in one or more of the plurality of sides. The first and second panels are each movable from a first closed position to a second open position allowing access to the interior of the body. The first and second panels form a continuous surface in the first closed position and are each substantially parallel to the bottom of the body in both the second open position and the third open position. In one more particular embodiment, the bottom and the plurality of sides include foam insulation and the first and second panels each include a vacuum insulated panel. In another more particular embodiment, the plurality of sides, and the first and second panels each include a vacuum insulated panel.

In one exemplary embodiment, a portable insulated storage container is provided. The storage container includes a body and a lid removably attached thereto. The body includes a bottom and plurality of sides extending from the bottom, the bottom and plurality of sides defining an interior. The lid includes a first panel and a second panel, wherein the first panel and the second panel are configured to be rotated between a first closed position and a second open position. The first panel and the second panel are each substantially parallel to the bottom of the body in the first open position and substantially parallel to one or more of the plurality of sides in the second open position. The first panel and second panel are configured to slide between the second open position and a third stored position. The first panel and second panel are each substantially parallel to and adjacent to one of the plurality of sides in the third stowed position. In one more particular embodiment, the bottom and the plurality of sides include foam insulation and the first and second panels each include a vacuum insulated panel. In another more particular embodiment, the plurality of sides, and the first and second panels each include a vacuum insulated panel.

In one exemplary embodiment, a portable insulated storage container includes a body and a lid. The body includes a bottom and plurality of sides extending from the bottom. The bottom and the plurality of sides define an interior storage volume of the portable insulated storage container. The lid is removably attachable to the body for closing the interior storage volume. The lid includes a lid base, a first lid member, and a second lid member. The first lid member is hingeably attached to the lid base on a first side of the lid base and the second lid member is hingeably attached to the lid base on a second side of the lid base opposite the first side. The first lid member and the second lid member are each independently movable from a first closed position to a second opened position for allowing access to the interior storage volume when the lid is attached to the body. Each of the first lid member and the second lid member includes a handle recess and a handle attached to the lid member in the respective handle recess. The handle of the first lid member is positioned in or extends at least partially into the handle recess of the second lid member and the handle of the second lid member is positioned in or extends at least partially into the handle recess of the first lid member when the first lid member is in the opened position and the second lid member is in the closed position.

In one exemplary embodiment, a portable insulated storage container is provided. The storage container includes a body and a lid removably attached thereto. The body includes a bottom and plurality of sides extending from the bottom, the bottom and plurality of sides defining an interior, wherein one of the sides of the plurality of sides includes one or more openings. The lid includes one or more hinges extending from the lid and configured to be received within the one or more openings. The storage container further includes a locking latch slidably attached to the body and including a plurality of projections. The locking latch is movable between a first position in which the one or more openings are configured to receive the one or more hinges and a second position in which at least one of the one or more projections abuts one of the one or more hinges, preventing the abutted hinge from being able to rotate or pivot relative to the body. In one more particular embodiment, another projection of the one or more projections is configured to abut a perimeter edge of the lid when the locking latch is in the second position, thereby preventing the lid from being able to rotate or pivot relative to the body. In another more particular embodiment, the bottom and plurality of sides include foam insulation and the lid includes a vacuum insulated panel. In still another more particular embodiment, the bottom, the plurality of sides, and the lid each include a vacuum insulated panel.

In one exemplary embodiment, a portable insulated storage container is provided. The storage container includes a body and a lid removably attached thereto. The body includes a bottom and plurality of sides extending from the bottom, the bottom and plurality of sides defining an interior. The lid extends from a first end to a second end. The first end includes a first pair of pivot pins each configured to be received within a first track of one of the sides of the plurality of sides. The lid is configured to rotate about the first pair of pivot pins within the first track to allow the lid to rotate from a first closed position to a first open position. The second end includes a second pair of pivot pins each configured to be received within a second track of another of the sides of the plurality of sides. The lid is configured to rotate about the second pair of pivot pins within the second track to allow the lid to rotate from a second closed position to a second open position providing access to the interior. In one more particular embodiment, the bottom and plurality of sides include foam insulation and the lid includes include a vacuum insulated panel. In another more particular embodiment, the bottom, the plurality of sides, and the lid each include a vacuum insulated panel.

In one exemplary embodiment, a portable insulated storage container is provided. The storage container includes a body and a lid removably attached thereto. The body includes a bottom and plurality of sides extending from the bottom, the bottom and plurality of sides defining an interior, wherein one of the sides of the plurality of sides includes one or more openings. The lid is attached to the body at a pair of pivot points. The lid is configured to rotate about the pair of pivot points between a first closed position and a second open position providing access to the interior, wherein the lid includes a vacuum insulated panel. In one more particular embodiment, the bottom and plurality of sides include foam insulation and the lid includes include a vacuum insulated panel. In another more particular embodiment, the bottom, the plurality of sides, and the lid each include a vacuum insulated panel.

In one more particular embodiment of any of the above embodiments, the portable insulated storage container further includes a tote at least partially surrounding the bottom and plurality of sides of the body. In another more particular embodiment of any of the above embodiments, the portable insulated storage container further includes a temperature control element.

In one exemplary embodiment, a portable insulated storage container is provided. The container includes an insulated main body and a removable insulated lid. The main body has a bottom and a plurality of sides. At least one of the plurality of sides includes an attachment region having a groove extending downwardly from a groove opening to a bottom of the groove. The groove further extends upwardly from the bottom of the groove to a pivot point. The insulated lid includes a first panel having a top surface and a bottom surface including a first projection, a second panel having a top surface and a bottom surface, and a pivot rod rotationally joining the first panel to the second panel. The insulated lid has a first configuration in which the top surface of the first panel is positioned proximate the top surface of the second panel, the insulated lid being configured to be inserted into the groove opening in the first configuration and moved through the groove to the bottom of the groove. The insulated lid is configured to be moved to a second configuration in which the top surface of the first panel is rotated away from the top surface of the second panel, the movement of the insulated lid from the first configuration to the second configuration causing the first projection to contact the main body and move the pivot pin upwardly into the pivot point.

Other variations and embodiments are possible, including variations and embodiments which do not necessarily include all of the elements described above or below and/or variations and embodiments which may include additional elements.

DETAILED DESCRIPTION

Figure 1:
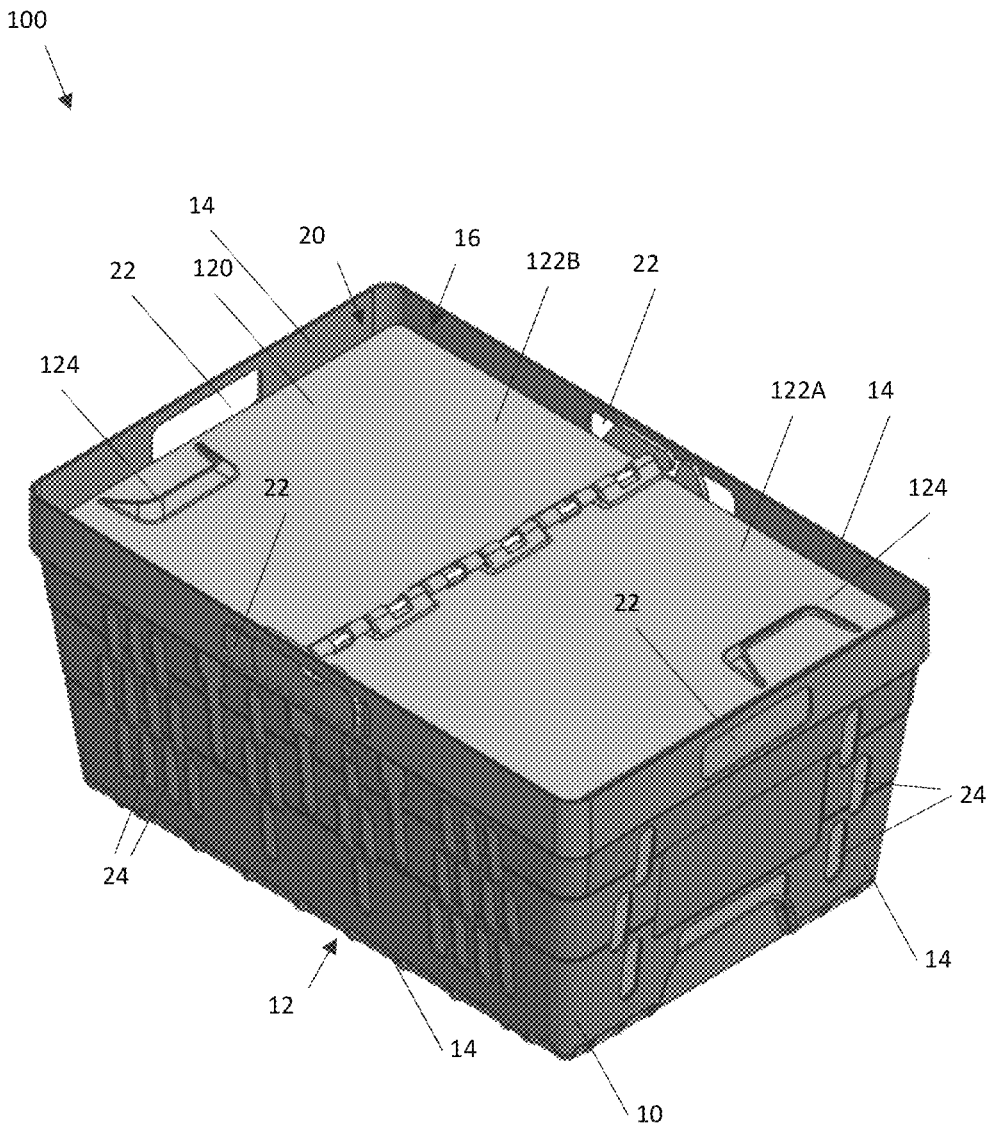
FIG. 1 illustrates a first exemplary insulated portable storage container with the lid in a closed position.
Figure 2:
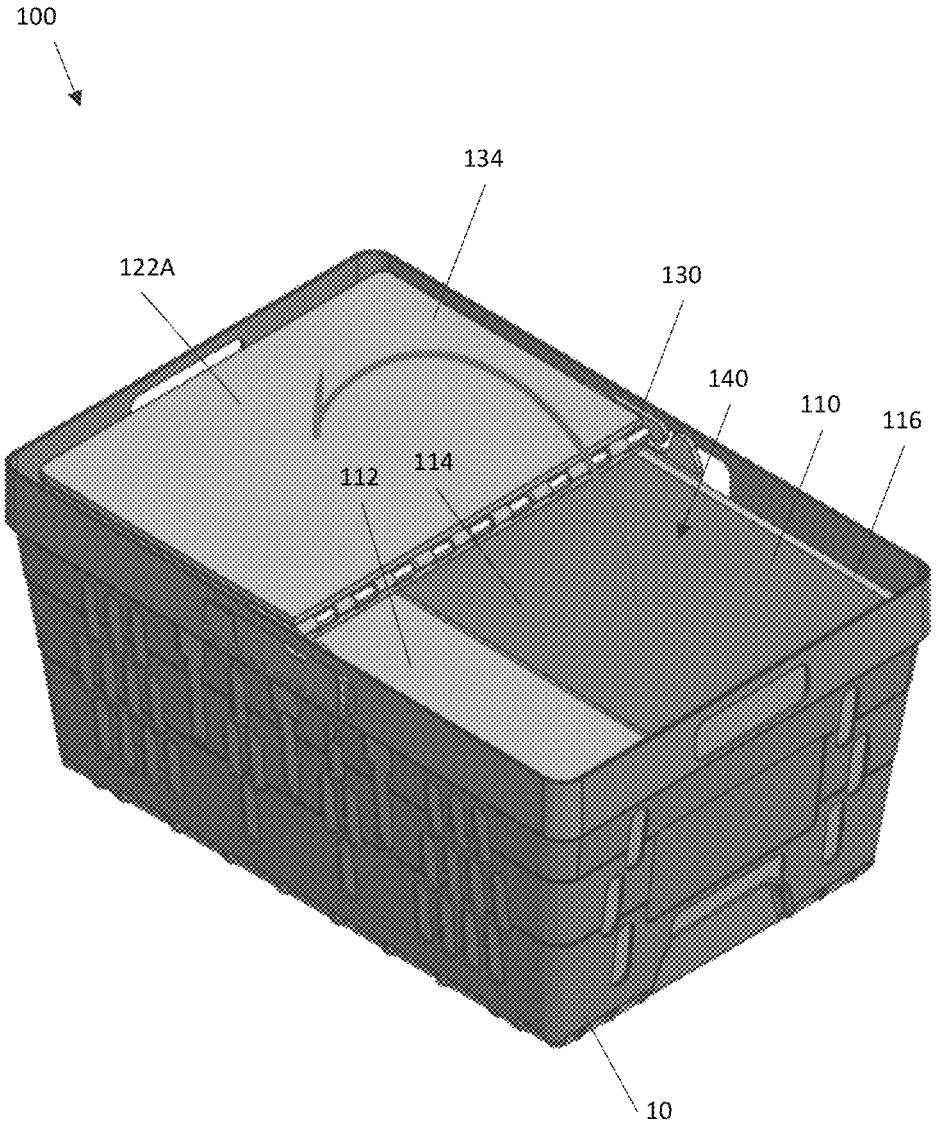
FIG. 2 illustrates the container of FIG. 1 with the lid in an open position.
Figure 3:
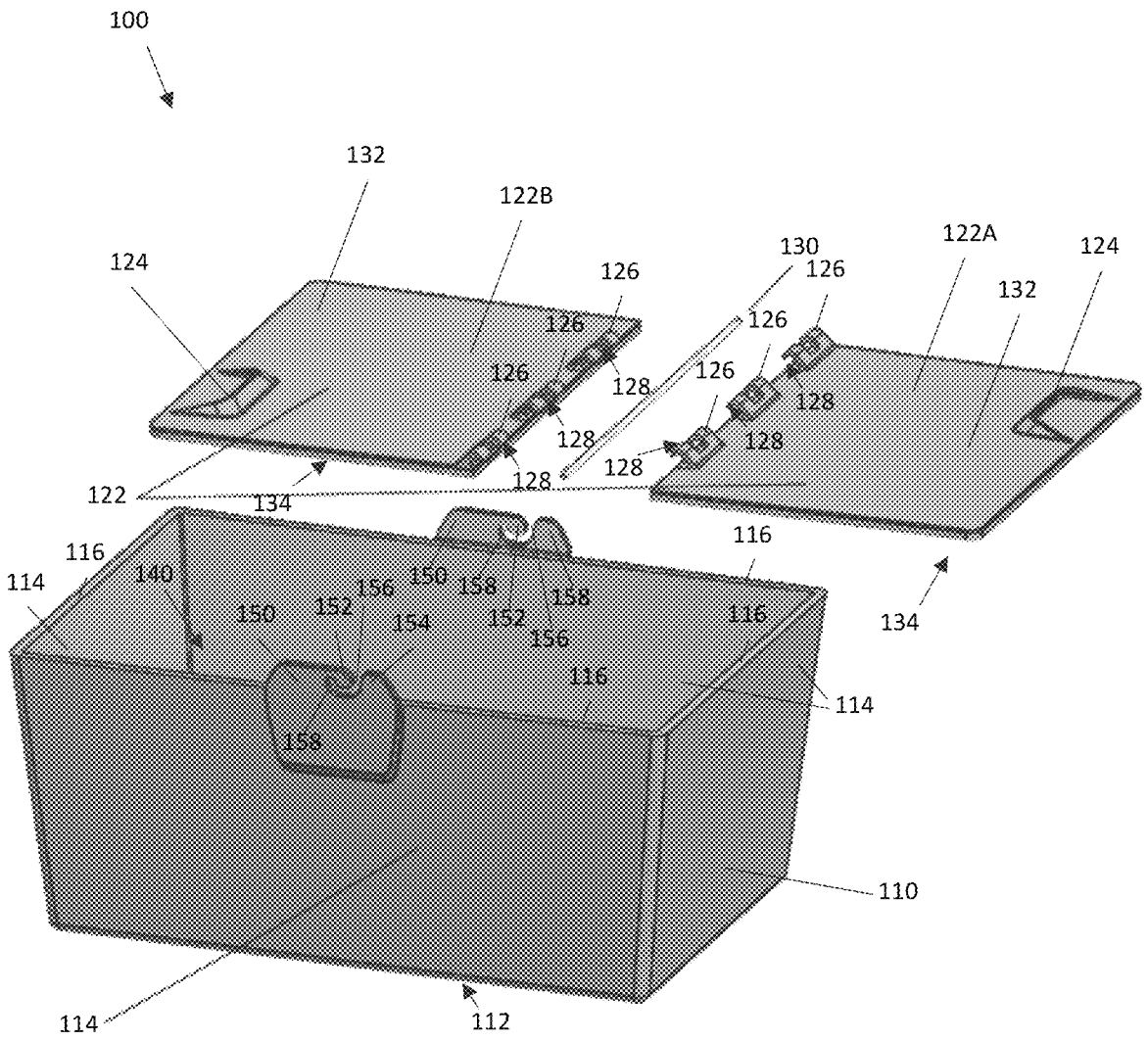
FIG. 3 illustrates an exploded view of the container of FIG. 1.

FIGS. 1-5 illustrate a portable storage container 100. FIG. 1 illustrates container 100 with the lid 120 in a closed position. FIG. 2 illustrates the container 100 with the lid 120 in a first open position. FIG. 3 illustrates an exploded view of container 100. FIG. 4A illustrates a side view of container 100 with a lid panel 122A at a first angle. FIG. 4B illustrates a side view of container 100 with a lid panel 122A at a first angle. FIGS. 5A-5C illustrates an exemplary method of installing lid 120 onto container 100.

Referring first to FIGS. 1 and 2, in some exemplary embodiments, portable storage container 100 includes a removable tote 10. Tote 10 includes a bottom 12 and one or more sides 14 extending upwardly from bottom 12. Tote 10 illustratively includes a top opening 16. The bottom 12 and sides 14 of tote 10 define an interior 20 for receiving container 100 through top opening 16. In other embodiments, portable storage container 200 does not include a removable tote 10.

In some embodiments, tote 10 is formed from a rigid material, such as molded plastic. In some embodiments, tote 10 is at least partially formed form a flexible material. Tote 10 illustratively includes one or more handles 22 positioned on one or more sides 14 to assist in carrying tote 10. In some embodiments, tote 10 includes one or more apertures 24 of various shapes and sizes to reduce an overall weight of tote 10.

In some embodiments, tote 10 does not include any thermal insulation. In some embodiments, tote 10 includes thermal insulation to help maintain a temperature of contents of container 100 and/or an internal temperature of container 100. Exemplary thermal insulation include polyurethane foam, expanded polypropylene foam, closed-cell extruded polystyrene foam, expanded polystyrene foam, polyisocyanurate foam, composite honeycomb materials, and vacuum insulated panels (VIPs).

Referring next to FIG. 3, an exploded view of container 100 is illustrated. Container 100 includes a main body 110 having a bottom 112 and one or more sides 114 extending upwardly from bottom 112. Each side 114 terminates in an upper surface 116. Although container 110 is illustrated as substantially rectangular in cross-section, in other embodiments, container 100 may be any suitable shape, including circular, oval, triangular, or a polygon having five or more sides.

Container 100 includes a lid 120 comprising one or more panels 122, such as first panel 122A and second panel 122B illustrated in FIG. 3. Each panel 122 includes a handle 124 for grasping the panel 122. Each panel 122 includes one or more knuckles 126 to hingeably attach the panel 122 to main body 110. Knuckle 126 includes an opening 128 for receiving hinge pivot rod 130. In some exemplary embodiments, knuckle 126 is formed from a flexible, resilient material and hinge pivot rod 130 is snapped into knuckle 126 though opening 128. In other exemplary embodiments, hinge pivot rod 130 is threaded through the openings 128 of a plurality of knuckles 126.

Bottom 112, sides 114, and lid 120 of container 100 illustratively include thermal insulation. Exemplary thermal insulation include polyurethane foam, expanded polypropylene foam, closed-cell extruded polystyrene foam, expanded polystyrene foam, polyisocyanurate foam, composite honeycomb materials, and vacuum insulated panels (VIPs). In some exemplary embodiments, bottom 112, sides 114, and lid 120 include foam insulation. In some exemplary embodiments, bottom 112, sides 114, and lid 120 include vacuum insulated panels. In some exemplary embodiments, bottom 112 and sides 114 include foam insulation and lid 120 includes vacuum insulated panels.

In some exemplary embodiments, the foam insulation in one or more of bottom 112, sides 114, and lid 120 has a thickness as little as 0.25", 0.5", 0.75", as great as 1", 1.25", 1.5", or greater, or within any range defined between any two of the foregoing values. In some exemplary embodiments, the foam insulation has a thermal resistance (R-value) per inch of thickness as little as about 3, about 4, about 5, as great as about 6, about 7, about 8, about 9, about 10, or within any range defined between any two of the foregoing values. In some exemplary embodiments, the foam insulation has a total thermal resistance (R-value) as little as about 3, about 4, about 5, as great as about 6, about 7, about 8, about 9, about 10, or within any range defined between any two of the foregoing values.

In some exemplary embodiments, the VIP in one or more of bottom 112, sides 114, and lid 120 has a thickness as little as 0.1", 0.15", 0.2", as great as 0.25", 0.3", 0.35", 0.4", 0.5", or greater, or within any range defined between any two of the foregoing values. In some exemplary embodiments, the VIP has a thermal resistance (R-value) per inch of thickness as little as about 10, about 15, about 20, as great as about 25, about 30, about 35, about 40, about 45, about 50, or greater, or within any range defined between any two of the foregoing values. In some exemplary embodiments, the VIP has a total thermal resistance (R-value) as little as about 3, about 4, about 5, as great as about 6, about 7, about 8, about 9, about 10, or within any range defined between any two of the foregoing values.

Figure 4A:
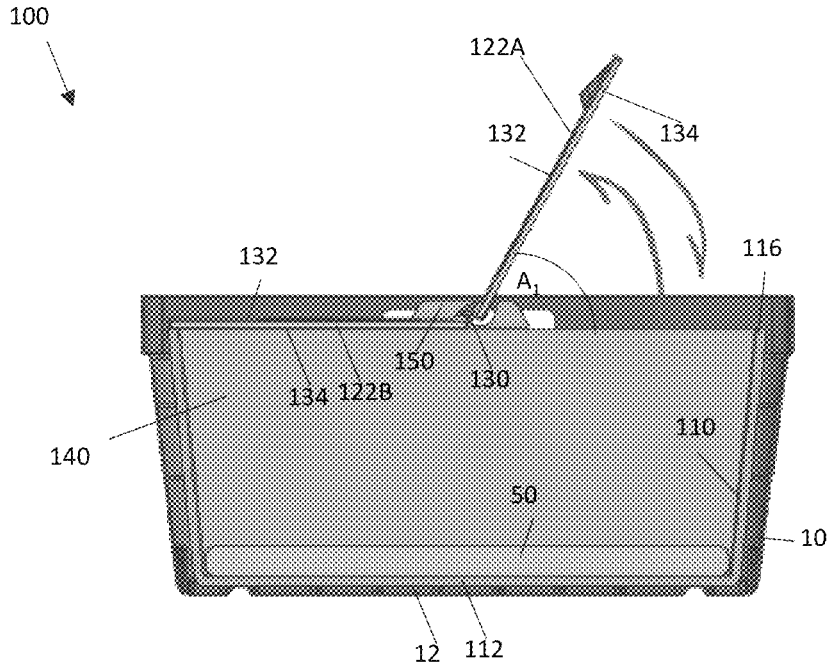
FIG. 4A illustrates a side view of the container of FIG. 1 with the lid at an angle less than 90°.
Figure 4B:
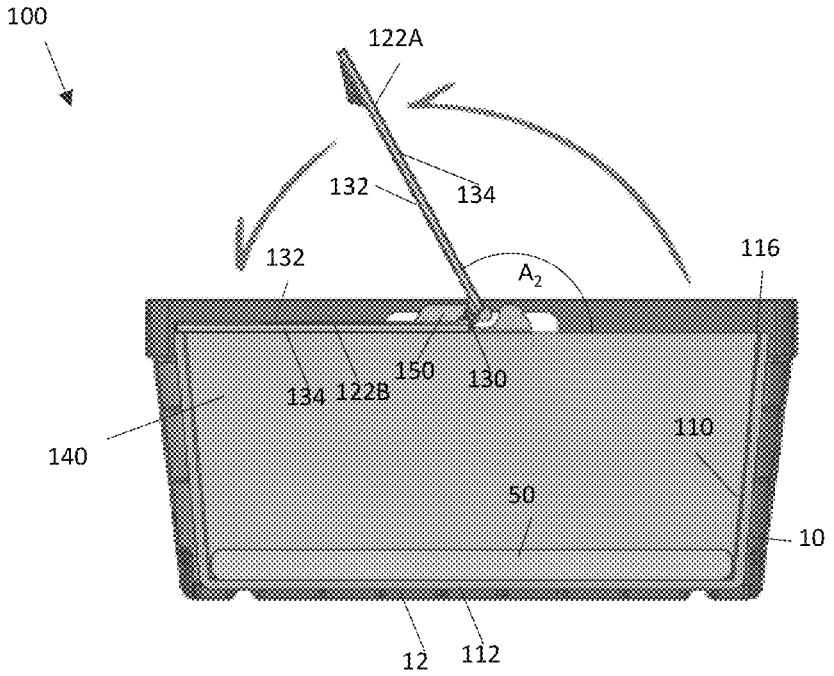
FIG. 4B illustrates a side view of the container of FIG. 1 with the lid at an angle greater than 90°.

Bottom 112, sides 114, and lid 120 of container 100 define an interior 140 of container 100. As illustrated in FIGS. 4A and 4B, in some exemplary embodiments, a temperature control device 50 may be provided in the interior 140 of container 100. Exemplary temperature control devices include devices for maintaining a warm or cold temperature within interior 140 of container 100, such as ice packs, dry ice, packages containing freezable liquids such as glycols or eutectic mixtures, and hot water bottles.

Each panel 122A, 122B includes a top surface 122 and an opposing lower surface 124. As illustrated in FIG. 1, in a closed position, the panels 122A and 122B provide a continuous surface enclosing the interior 140 to container 100. As illustrated in FIG. 2, either first panel 122A or second panel 122B may be rotated about hinge pivot rod 130 to an open position providing access to the interior 140 of container 100.

As illustrated in FIG. 4A, if either panel 122 is opened to an angle $A_1$ less than about 90°, the panel 122 will fall back to a closed position. As illustrated in FIG. 4B, if either panel 122 is opened to an angle $A_2$ greater than about 90°, the panel 122 will fall over to an open position. Accordingly, the first panel 122A and second panel 122B are parallel to each other in either open position.

As illustrated in FIG. 3, main body 110 includes one or more attachment regions 150. In some embodiments, each attachment region 150 is integrally formed with one or more sides 114. In other embodiments, each attachment region 150 is attached to one or more sides 114. In some embodiments, each attachment region 150 is formed from a resilient or flexible material. Each attachment region 150 illustratively includes a first edge 152 and a second edge 154 bounding a curved groove 156 for receiving hinge pivot rod 130. Curved groove 156 terminates in resting position 158, forming a hinge axis for hinge pivot rod 130.

Figure 5A:
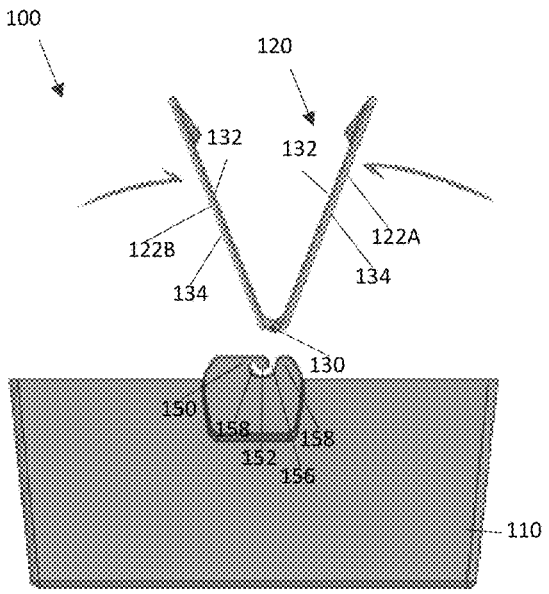
FIGS. 5A-5C illustrate an exemplary method of installing the lid on the container of FIG. 1.
Figure 5B:
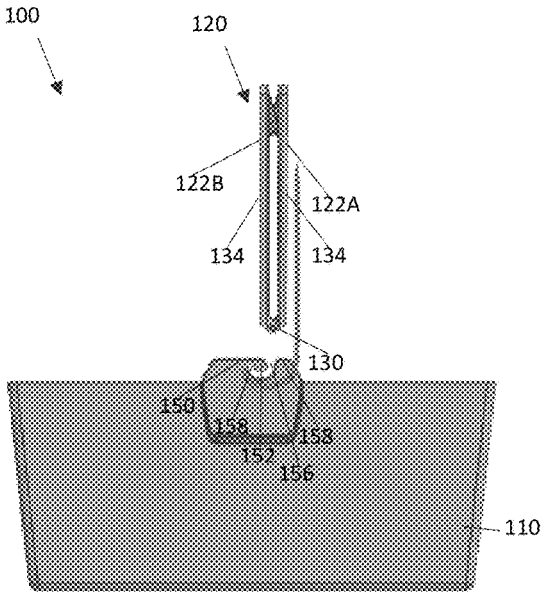
Figure 5C:
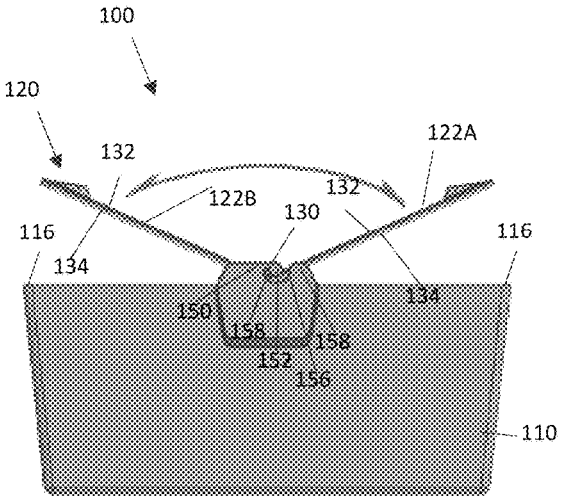

Referring next to FIGS. 5A-5C, an exemplary method of installing lid 120 on main body 110 is illustrated. As shown in FIG. 5A, the two panels 122A, 122B are rotated about hinge pivot rod 130 until the top surface 132 of panel 122A is facing the top surface 132 of panel 122B, and panel 122A is substantially parallel to panel 122B. As shown in FIG. 5B, hinge pivot rod 130 is inserted between first edge 152 and second edge 154 into groove 156 of attachment region 150, and maneuvered to resting position 158. As shown in FIG. 5C, the panels 122A and 122B are then rotated to the closed position, such that the lower surface 134 of each panel 122 is resting on upper surface 116 of sides 116 of main body 110.

Figure 6:
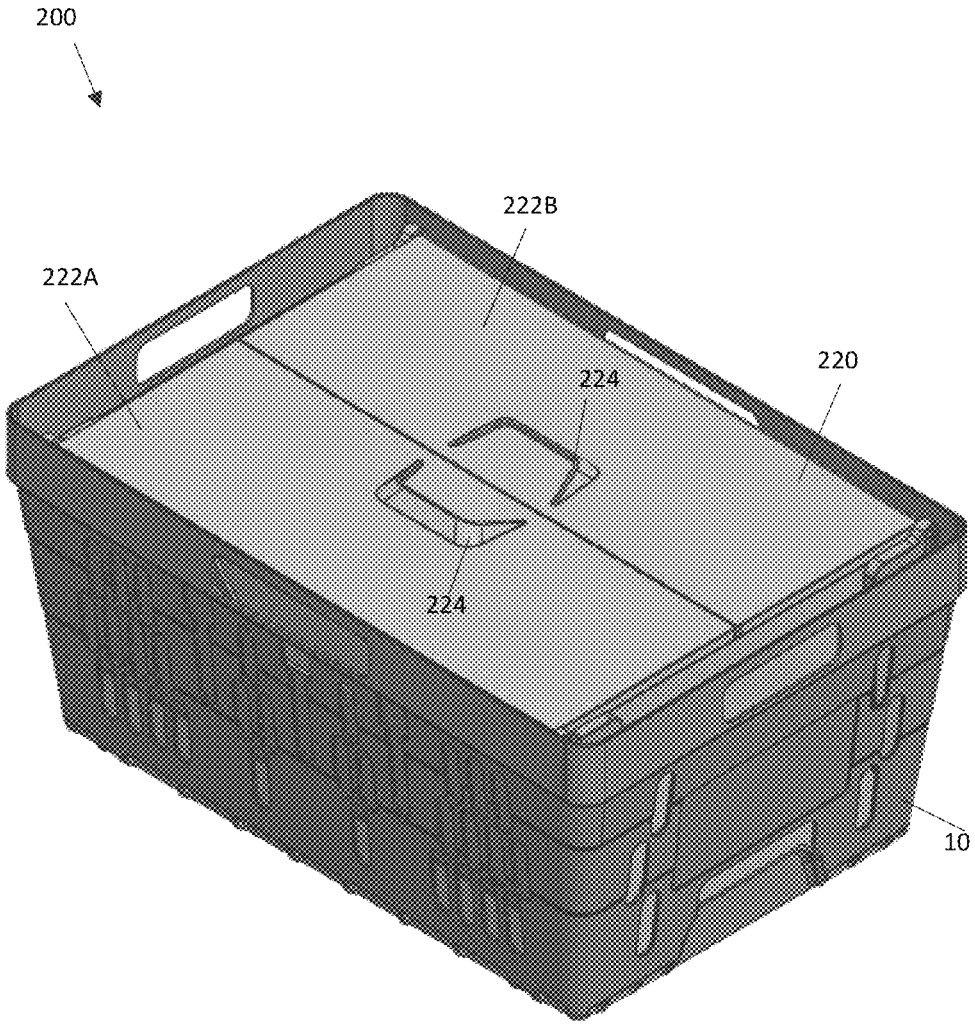
FIG. 6 illustrates a second exemplary insulated portable storage container with the lid in a closed position.
Figure 7:
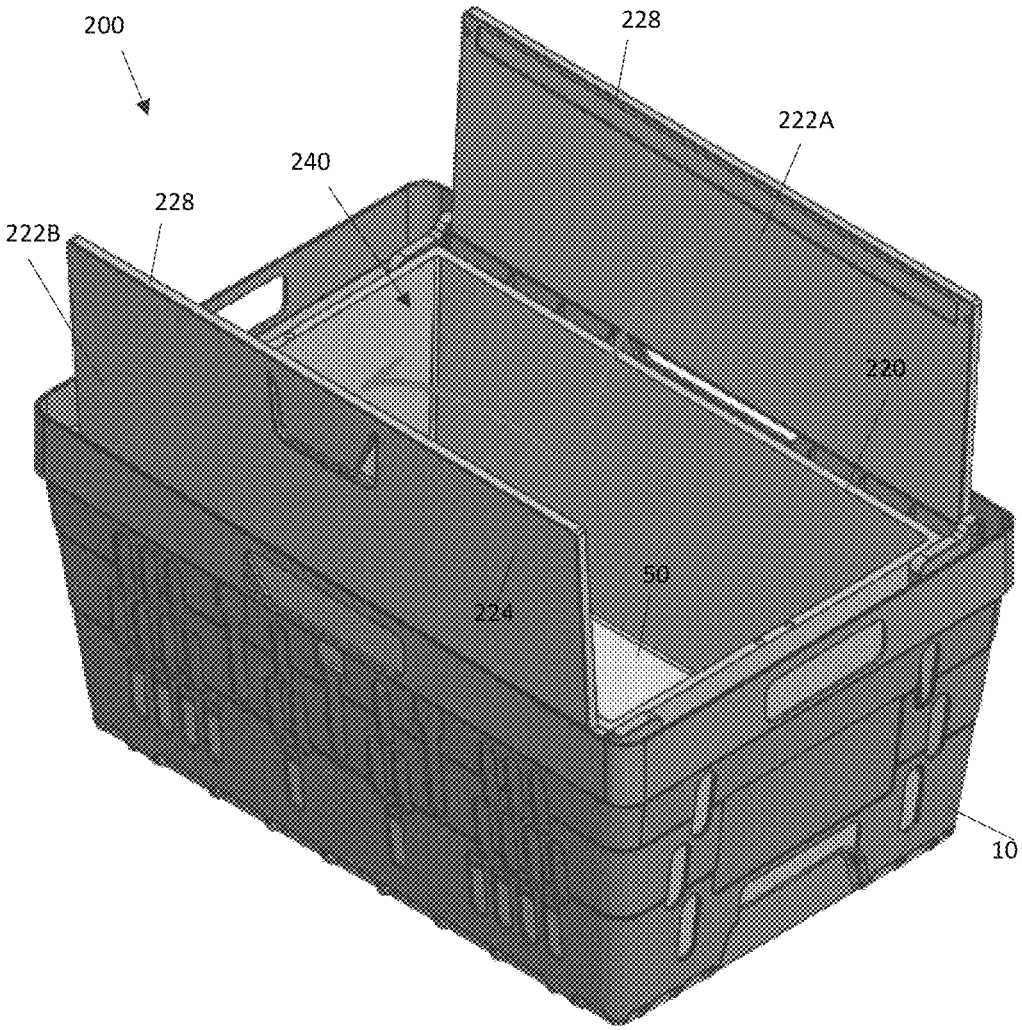
FIG. 7 illustrates the container of FIG. 6 with the lid in an open position.
Figure 8:
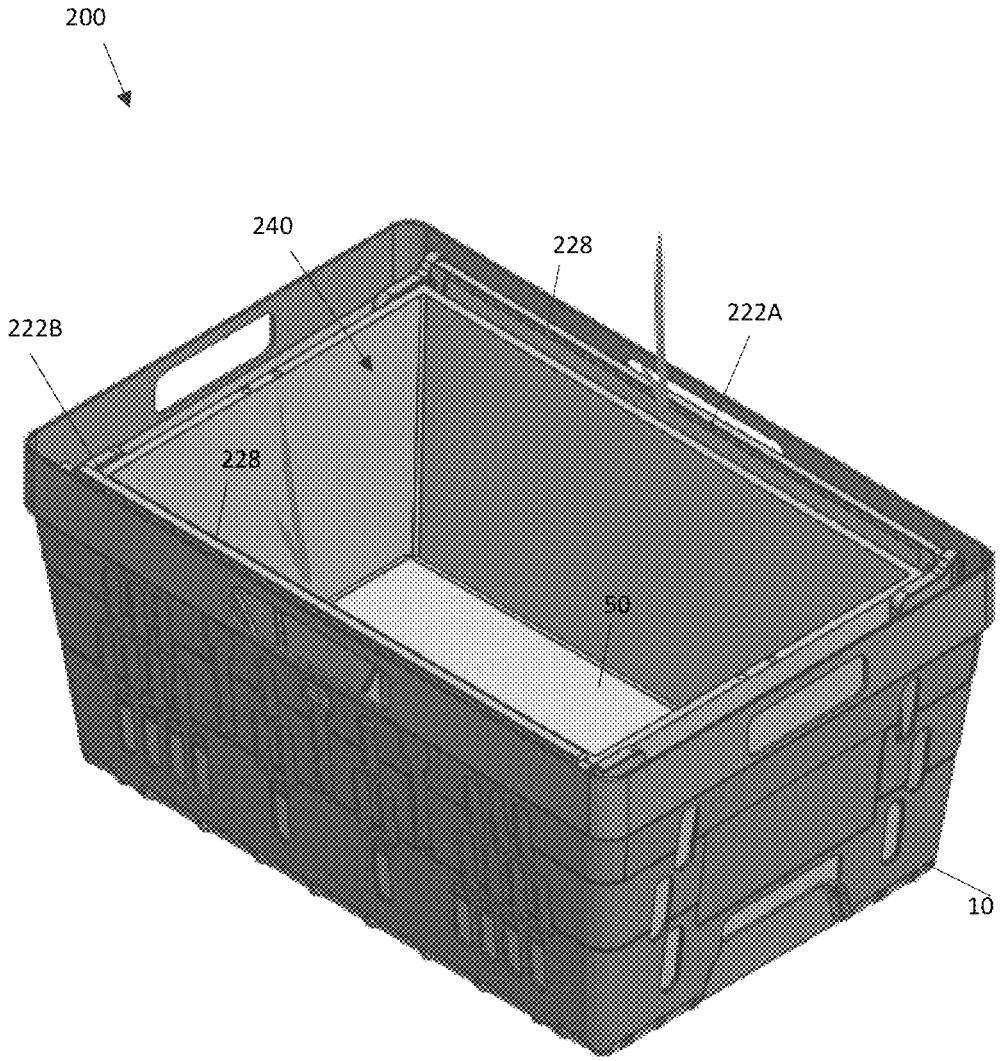
FIG. 8 illustrates the container of FIG. 6 with the lid in a stowed position.
Figure 9:
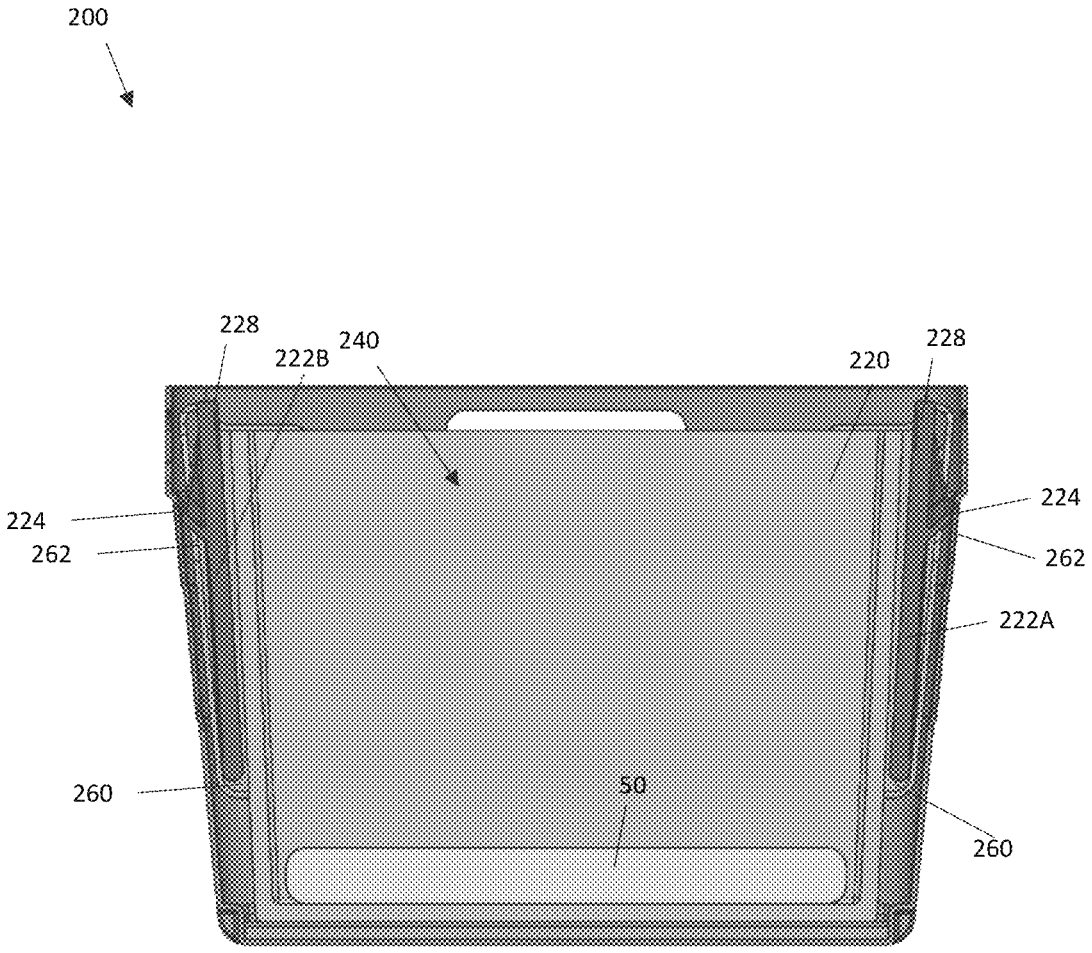
FIG. 9 illustrates a sectional view of the container of FIG. 6 with the lid in the stowed position.
Figure 10:
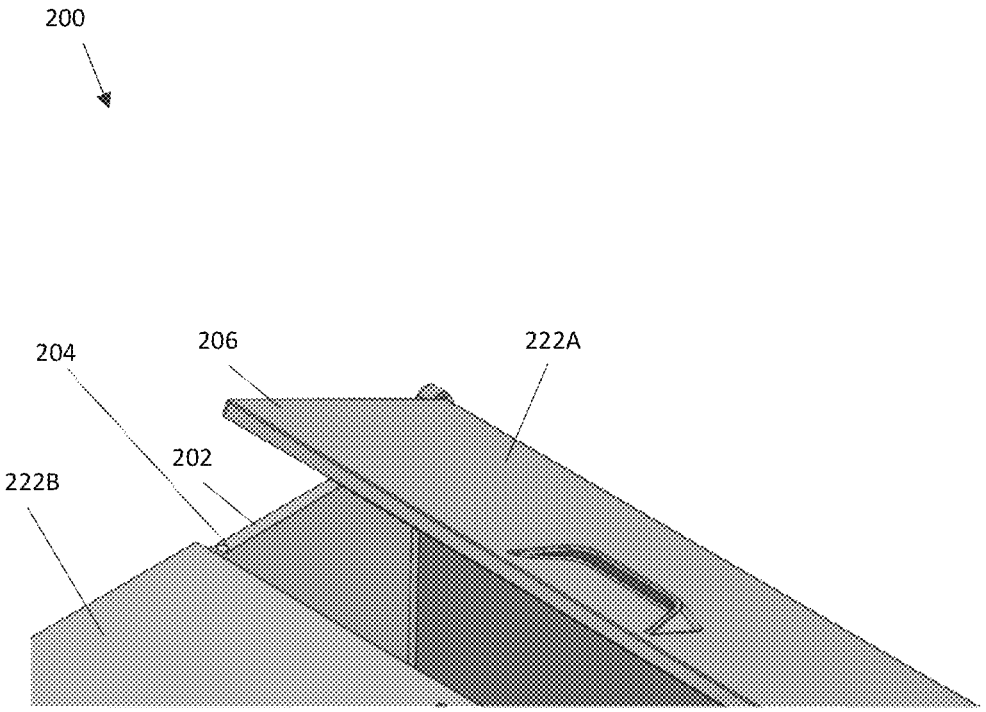
FIG. 10 illustrates an enlarged view of the container of FIG. 6 with the lid in a partially open position.
Figure 11:
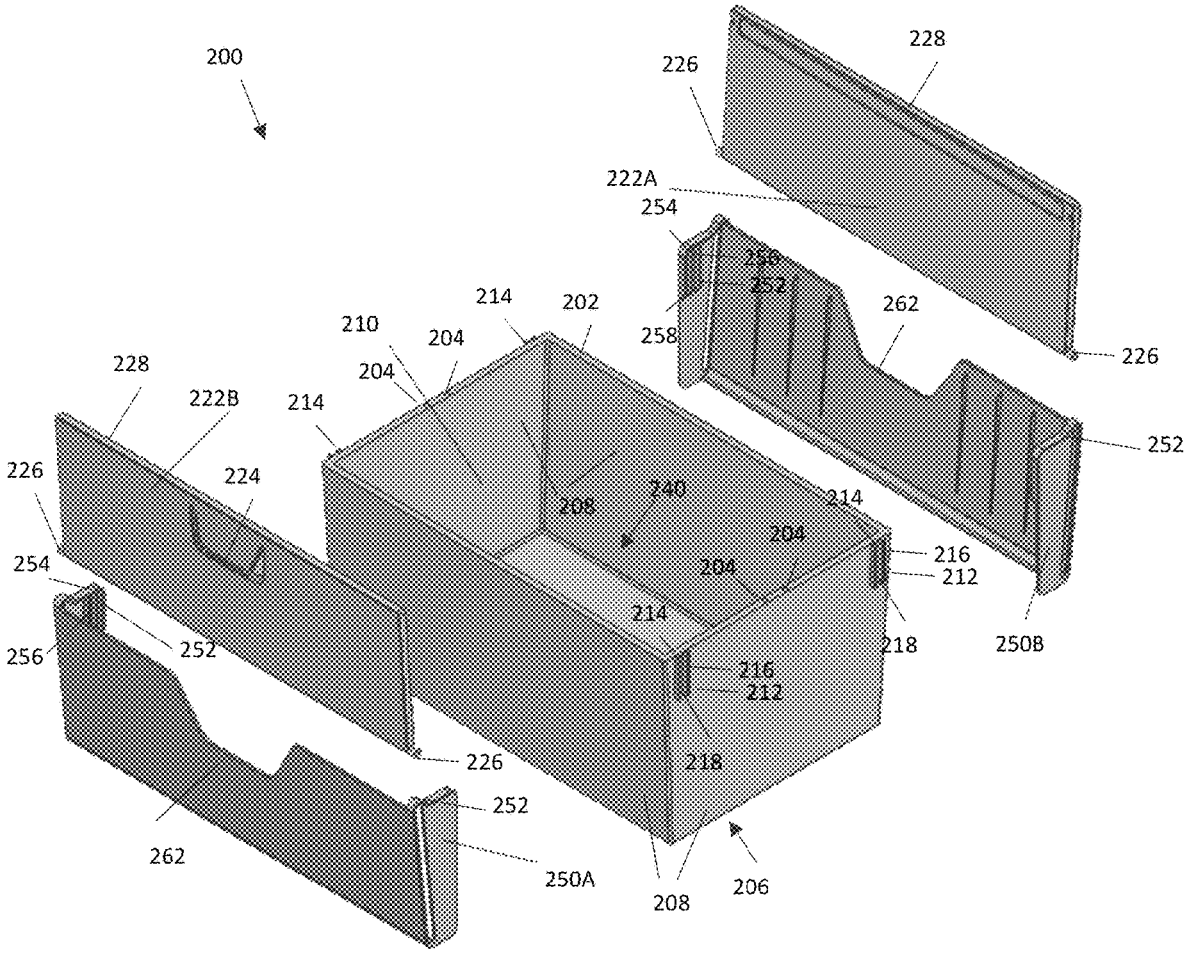
FIG. 11 illustrates an exploded view of the container of FIG. 6.

FIGS. 6-11 illustrate a portable storage container 200. FIG. 6 illustrates container 200 with the lid panels 222, 222 in a first closed position. FIG. 7 illustrates container 200 with the lid panels 222A, 222B in a second open position providing access to an interior 240 of container 200. FIG. 8 illustrates container 200 with the lid panels 222A, 222B in a third stowed position. FIG. 9 illustrates a sectional view of container 200 showing the lid panels 222A, 222B in the third stowed position. FIG. 10 illustrates an enlarged view of panel 220A of container 200. FIG. 11 illustrates an exploded view of container 200.

In some exemplary embodiments, portable storage container 200 includes a removable tote 10. In other embodiments, portable storage container 200 does not include a removable tote 10.

As illustrated in FIG. 11, container 200 includes a main body 210 and a lid 220 comprising a first panel 222A and a second panel 222B. Main body 210 includes a bottom 206 and one or more sides 208 extending from the bottom. The bottom 206 and sides 208 of main body 210 define an interior 240 of container 200. In some exemplary embodiments, a temperature control device 50 may be provided in the interior 240 of container 200. Each panel 222 may include one or more handles 224 used for opening the lid 220. Each panel 222 further includes one or more pivot pins 226 extending outward from the panel 222.

Container 220 further includes first and second panel guides 250A, 250B. A cavity 260 is defined between the main body 210 and each panel guide 250A, 250B. Each cavity 260 is configured or adapted to at least partially store one of the panels 222 when the panel is in the third stowed position (see FIG. 8).

Main body 210 includes one or more pivot channels 212 corresponding to the one or more pivot pins 226 of the panels 222. Each pivot channel 212 includes a closed upper end 214 and a channel 216 extending downward from the closed upper end 214 to an open lower end 218.

Each panel guide 250 includes one or more pivot channels 252 corresponding to the one or more pivot pins 226 of the panels 222. Each pivot channel 252 of the channel guides 250 is paired with a pivot channel 212 of the main body 210 and includes a closed upper end 254 and a channel 256 extending downward from the closed upper end 254 to an open lower end 258.

To move the first and second panels 222A, 222B from the first closed position (FIG. 6) to the second open position (FIG. 7), the pivot pins 226 of the panels 222 rotate within the closed upper ends 214, 254 of pivot channels 212, 252, allowing each panel 222 to independently hinge open from a centerline of the container 200 outwardly.

Once the panels 222 are moved to the second open position, or about 90 degrees from the closed position, the pivot pins 226 of each panel 222 slide downwardly through channels 216, 256 of pivot channels 212, 252, lowering each panel 222 into a corresponding cavity 260 between the main body 210 and panel guide 250. In some embodiments, the pivot pins 226 travel through the open lower ends 218, 258 of pivot channels 212, 252 as the panels are moved to the third stowed position. In some embodiments, the handles 224 of the panel 222 rest on an upper edge 262 of the panel guide 250 in the third stowed position. In some more particular embodiments, the upper edge 262 upon which the handles 224 rest is recessed from or lower than another portion of the upper edge of the panel guide 250.

To move the first and second panels from the third stowed position to the second open position, a centerline portion 228 of the panel 222 is grasped by the user and pulled upward, the upward movement moving the panel 222 out of cavity 260 and moving pivot pins 222 through the open lower ends 218, 258 and into channels 216, 256 of pivot channels 212, 252 and into the channels until they contact the closed upper ends 214, 254.

Once the panels 222 are in the second open position, the pivot pins 222 are then rotated within the closed upper ends 214, 254 of pivot channels 212, 252 until the panels 222 are rotated 90 degrees and allowed to rest on an upper surface 202 of main body 210. As shown in FIG. 10, in some embodiments, upper surface 202 includes one or more magnets or magnetically attractable areas 204 configured to attract and releasably secure a corresponding magnet or magnetically attractable area 206 on panel 222 to secure panel 222 in the first closed position.

First and second panels 222 are independently movable from a first closed position (FIG. 6) to a second open position (FIG. 7) to a third stowed position (FIG. 8).

Bottom 206, sides 208, and lid 220 of container 200 illustratively include thermal insulation. Exemplary thermal insulation include polyurethane foam, expanded polypropylene foam, closed-cell extruded polystyrene foam, expanded polystyrene foam, polyisocyanurate foam, composite honeycomb materials, and vacuum insulated panels (VIPs). In some exemplary embodiments, bottom 206, sides 208, and lid 220 include foam insulation. In some exemplary embodiments, bottom 206, sides 208, and lid 220 include vacuum insulated panels. In some exemplary embodiments, bottom 206 and sides 208 include foam insulation and lid 220 includes vacuum insulated panels.

In some exemplary embodiments, the foam insulation in one or more of bottom 112, sides 114, and lid 120 has a thickness as little as 0.25", 0.5", 0.75", as great as 1", 1.25", 1.5", or greater, or within any range defined between any two of the foregoing values. In some exemplary embodiments, the foam insulation has a thermal resistance (R-value) per inch of thickness as little as about 3, about 4, about 5, as great as about 6, about 7, about 8, about 9, about 10, or within any range defined between any two of the foregoing values. In some exemplary embodiments, the foam insulation has a total thermal resistance (R-value) as little as about 3, about 4, about 5, as great as about 6, about 7, about 8, about 9, about 10, or within any range defined between any two of the foregoing values.

In some exemplary embodiments, the VIP in one or more of bottom 206, sides 208, and lid 220 has a thickness as little as 0.1", 0.15", 0.2", as great as 0.25", 0.3", 0.35", 0.4", 0.5", or greater, or within any range defined between any two of the foregoing values. In some exemplary embodiments, the VIP has a thermal resistance (R-value) per inch of thickness as little as about 10, about 15, about 20, as great as about 25, about 30, about 35, about 40, about 45, about 50, or greater, or within any range defined between any two of the foregoing values. In some exemplary embodiments, the VIP has a total thermal resistance (R-value) as little as about 3, about 4, about 5, as great as about 6, about 7, about 8, about 9, about 10, or within any range defined between any two of the foregoing values.

Figure 12:
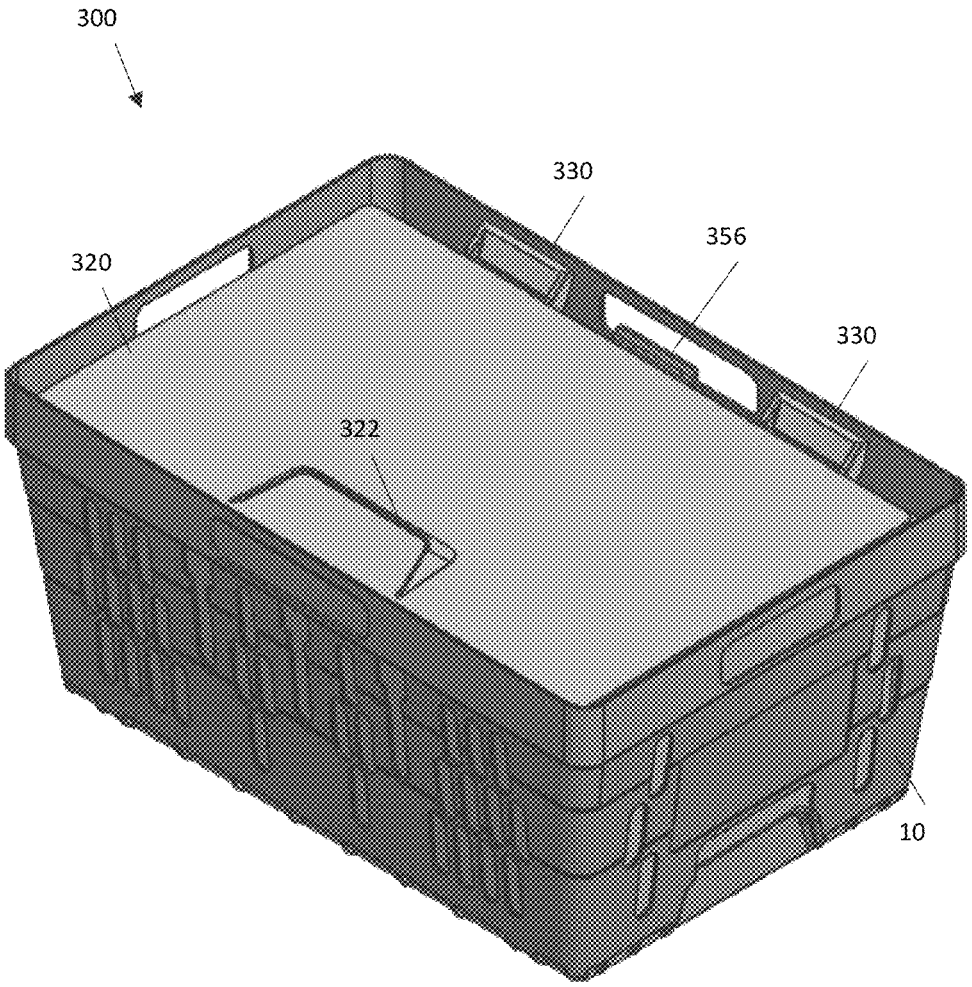
FIG. 12 illustrates a third exemplary insulated portable storage container with the lid in a closed position.
Figure 13:
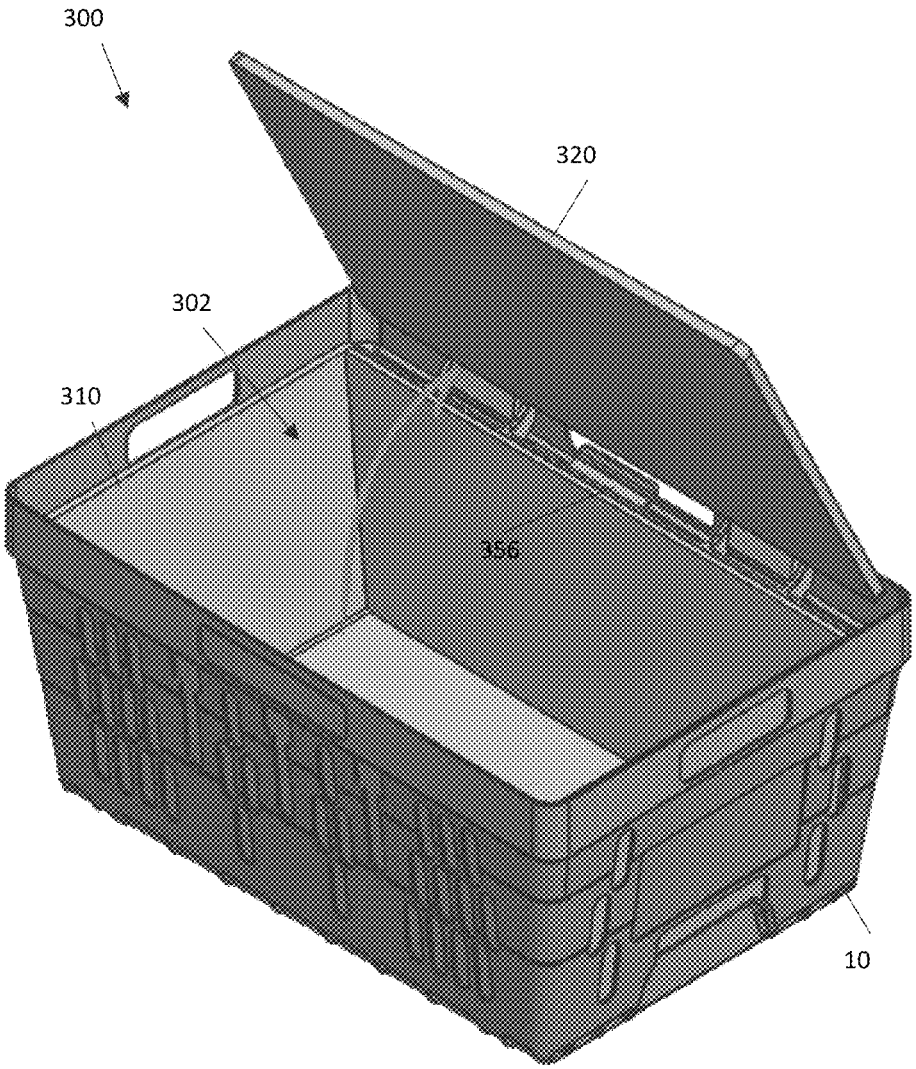
FIG. 13 illustrates the container of FIG. 12 with the lid in an open position.
Figure 14:
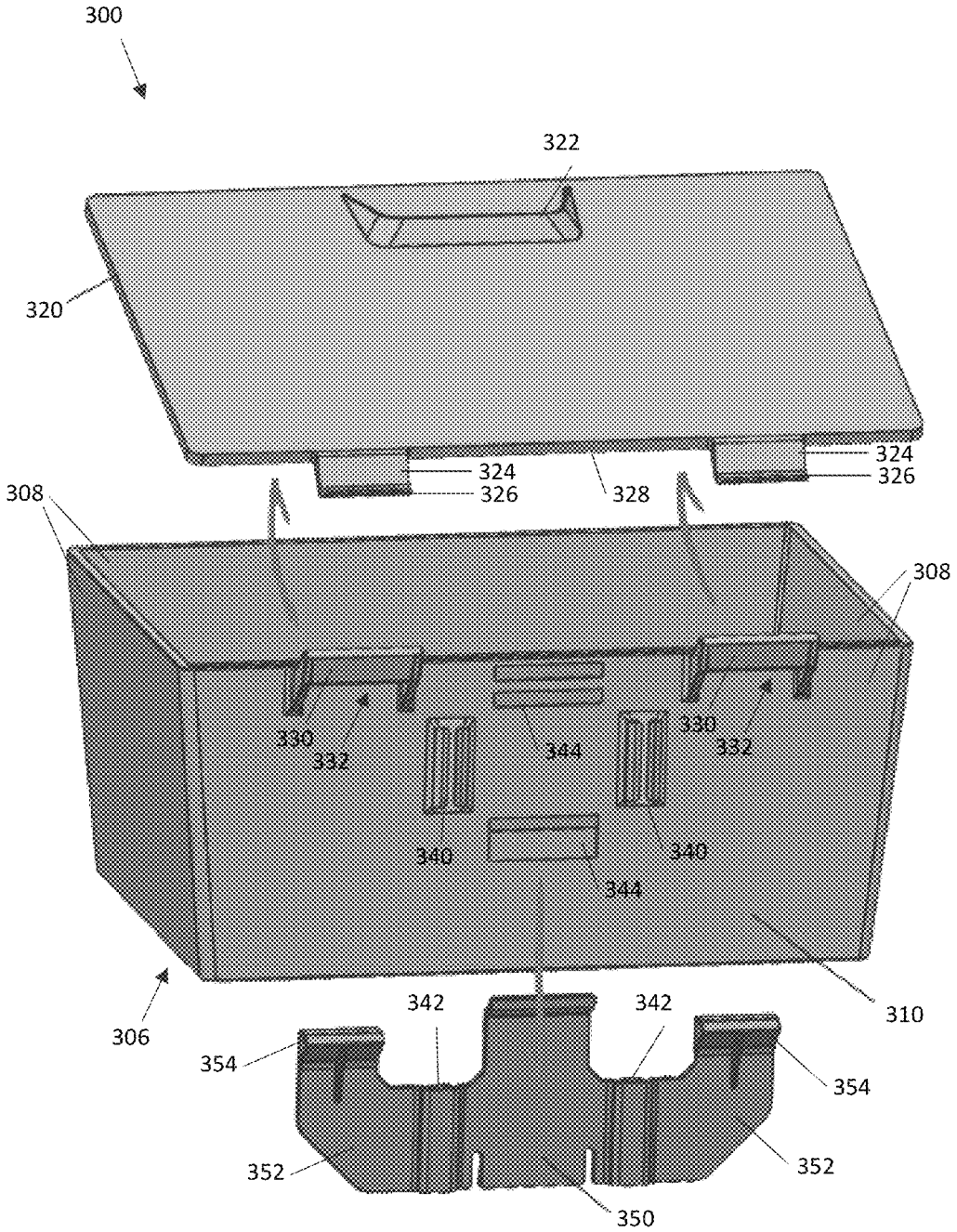
FIG. 14 illustrates an exploded view of the container of FIG. 12.

FIGS. 12-15D illustrate a portable storage container 300. FIG. 12 illustrates container 300 with the lid 320 in a first closed position. FIG. 13 illustrates container 300 with the lid 320 in a second open position providing access to an interior 302 of container 300. FIG. 14 illustrates an exploded view of container 300. FIGS. 15A-15C illustrate an exemplary method of installing and locking the lid 320 on container 300.

In some exemplary embodiments, portable storage container 300 includes a removable tote 10. In other embodiments, portable storage container 300 does not include a removable tote 10.

Container 300 includes a main body 310 and a removable lid 320. Lid 320 may include one or more handles 322 to assist in opening and closing lid 320. Lid 320 also includes one or more hinges 324 extending outwardly from lid 320 and terminating in an end portion 326.

Main body 310 includes a bottom 306 and one or more sides 308 extending from the bottom. The bottom 306 and sides 308 of main body 310 define an interior 302 of container 200. In some exemplary embodiments, a temperature control device 50 may be provided in the interior 302 of container 300.

Figure 15A:
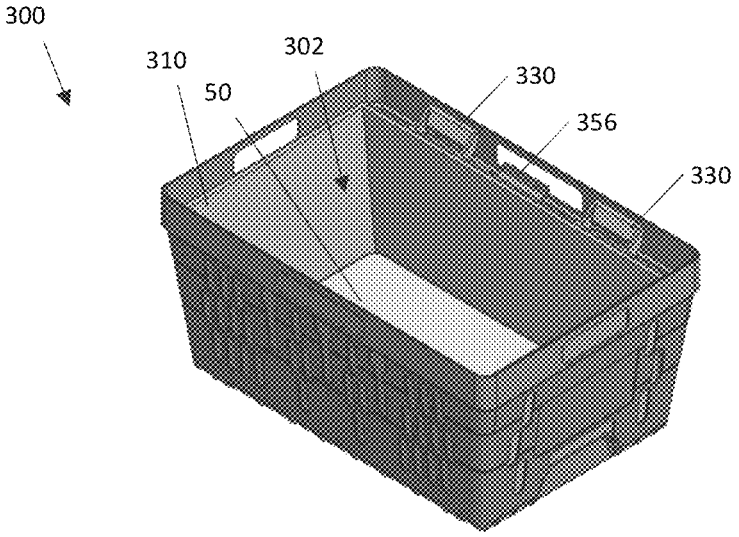
FIGS. 15A-15D illustrate an exemplary method of installing and locking the lid on the container of FIG. 12.
Figure 15B:
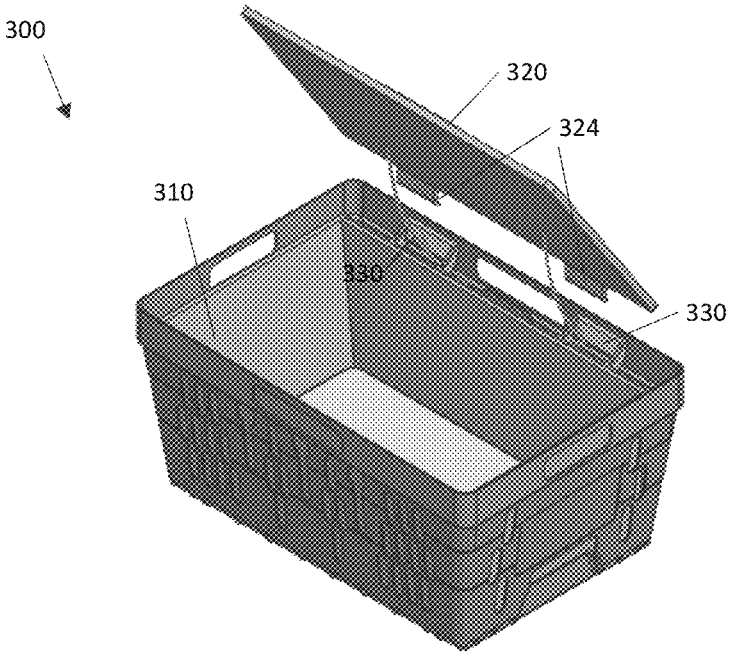

As shown in FIG. 14, main body 310 includes one or more hinge receiving portions 330 for receiving the hinges 324 of lid 320. Each hinge receiving portion 330 includes an aperture 332 into which the end portion 326 and hinge 324 of lid 320 are inserted, as shown in FIGS. 15A and 15B. Once the hinges 324 of lid 320 are inserted into the hinge receiving portions 330 of main body 310, the lid will fall to the first closed position when release, as shown in FIG. 12.

Main body 310 further includes one or more latch mounts 340 for slidably attaching to hinge locking latch 350. Latch mounts 340 allow latch 350 to slide between an unlocked position in which the lid 320 is permitted to move between the first closed position (FIG. 12) and the second open position (FIG. 13), and a locked position in which the lid 320 is not permitted to move between the first closed and second open positions. As shown in FIG. 14, in some embodiments latch mounts 340 are configured as grooves or recesses for receiving a corresponding rail 342 positioned on latch 350.

Locking latch 350 includes one or more hinge locking regions 352, In the embodiment illustrated in FIG. 14, latch 350 includes two hinge locking regions 352 corresponding to the two hinges 324 of lid 320. Each hinge locking regions 352 includes a stop 354 configured to abut the end portion 326 of a hinge 324 to prevent lid 320 from opening when the latch 350 is in the locked position.

Hinge locking latch 350 further includes a lid locking stop 356 configured to abut an edge 328 of lid 320 to prevent 320 from opening when the latch 350 is in the locked position.

Figure 15C:
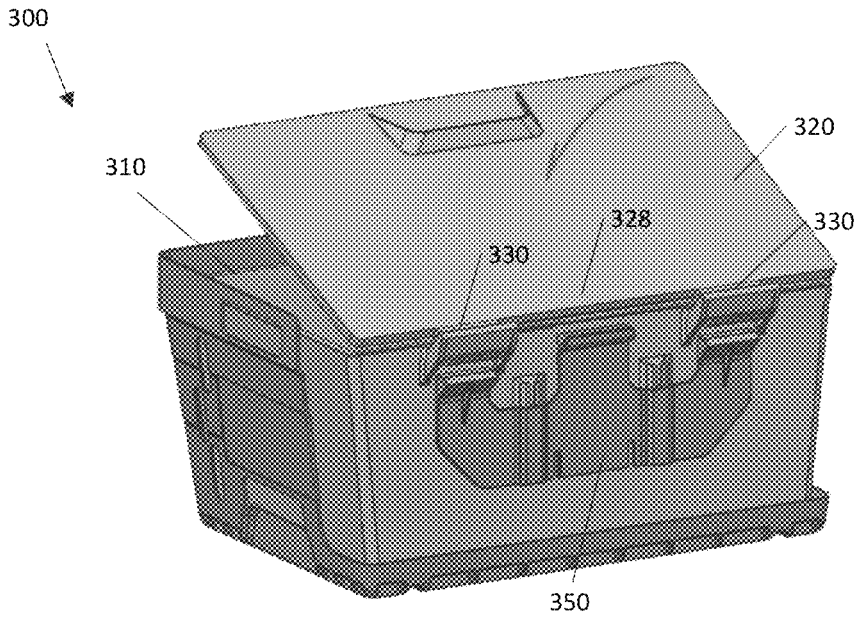
Figure 15D:
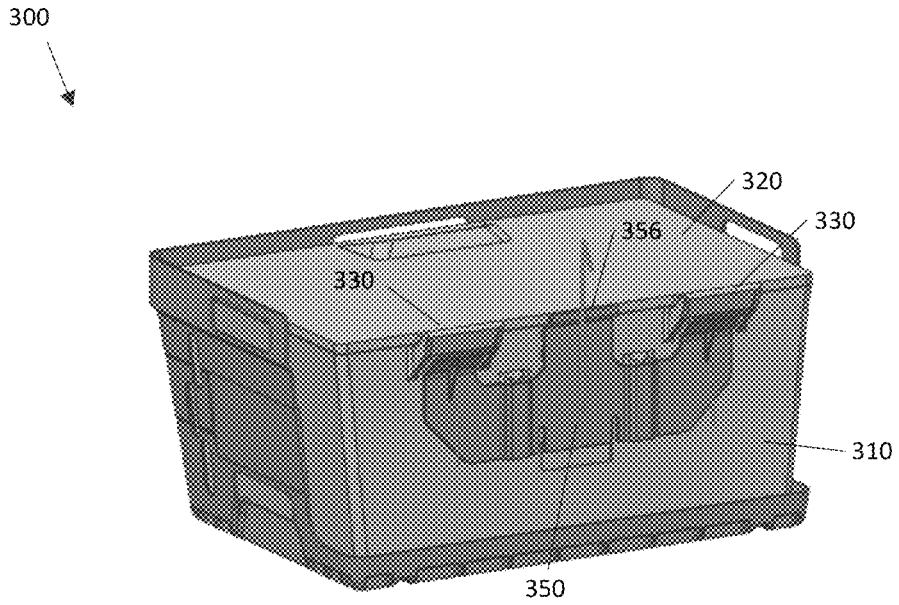

Referring next to FIGS. 15A-15D, an exemplary method of installing and locking lid 320 is illustrated. The main body 310 is illustrated in FIG. 15A with a temperature control device 50 positioned in interior 302 of container 300. In FIG. 15B, the end portion 326 and hinge 325 of lid 320 are inserted into hinge receiving portions 330 through aperture 332. As shown in FIG. 15C, the lid 320 is then moved towards a closed position. Lid 320 can freely move between the first closed position (FIG. 12) and second open position (FIG. 13) as long as the latch 350 is in the unlocked position.

In FIG. 15C, the hinge locking latch 350 is slid into the locked position. In the locked position, stops 354 of hinge locking regions 352 abut the end portion 326 of each hinge 324, preventing the hinges 324 from pivoting or rotating in hinge receiving portions 330, which therefore prevents lid 320 from pivoting or rotating between the first closed position and the second open position. In the locked position, lid locking stop 356 at least partially covers an edge 328 of lid 320 to further prevent lid 320 from pivoting or rotating between the first closed position and the second open position. Latch 350 may be removably held in the locked position by one or more friction stops 344 on main body 310.

Bottom 306, sides 308, and lid 320 of container 300 illustratively include thermal insulation. Exemplary thermal insulation include polyurethane foam, expanded polypropylene foam, closed-cell extruded polystyrene foam, expanded polystyrene foam, polyisocyanurate foam, composite honeycomb materials, and vacuum insulated panels (VIPs). In some exemplary embodiments, bottom 306, sides 308, and lid 320 include foam insulation. In some exemplary embodiments, bottom 306, sides 308, and lid 320 include vacuum insulated panels. In some exemplary embodiments, bottom 306 and sides 308 include foam insulation and lid 320 includes vacuum insulated panels.

In some exemplary embodiments, the foam insulation in one or more of bottom 306, sides 308, and lid 320 has a thickness as little as 0.25", 0.5", 0.75", as great as 1", 1.25", 1.5", or greater, or within any range defined between any two of the foregoing values. In some exemplary embodiments, the foam insulation has a thermal resistance (R-value) per inch of thickness as little as about 3, about 4, about 5, as great as about 6, about 7, about 8, about 9, about 10, or within any range defined between any two of the foregoing values. In some exemplary embodiments, the foam insulation has a total thermal resistance (R-value) as little as about 3, about 4, about 5, as great as about 6, about 7, about 8, about 9, about 10, or within any range defined between any two of the foregoing values.

In some exemplary embodiments, the VIP in one or more of bottom 306, sides 308, and lid 320 has a thickness as little as 0.1", 0.15", 0.2", as great as 0.25", 0.3", 0.35", 0.4", 0.5", or greater, or within any range defined between any two of the foregoing values. In some exemplary embodiments, the VIP has a thermal resistance (R-value) per inch of thickness as little as about 10, about 15, about 20, as great as about 25, about 30, about 35, about 40, about 45, about 50, or greater, or within any range defined between any two of the foregoing values. In some exemplary embodiments, the VIP has a total thermal resistance (R-value) as little as about 3, about 4, about 5, as great as about 6, about 7, about 8, about 9, about 10, or within any range defined between any two of the foregoing values.

Figure 16:
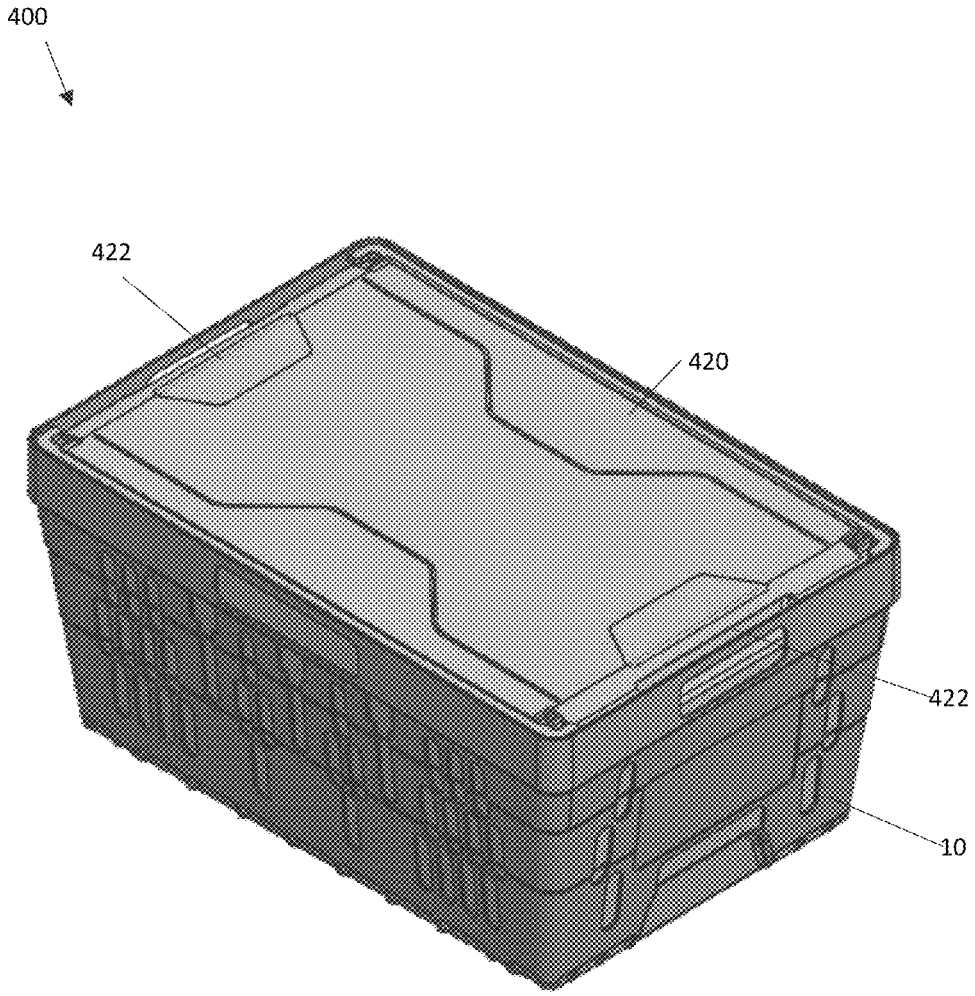
FIG. 16 illustrates a fourth exemplary insulated portable storage container with the lid in a closed position.
Figure 17A:
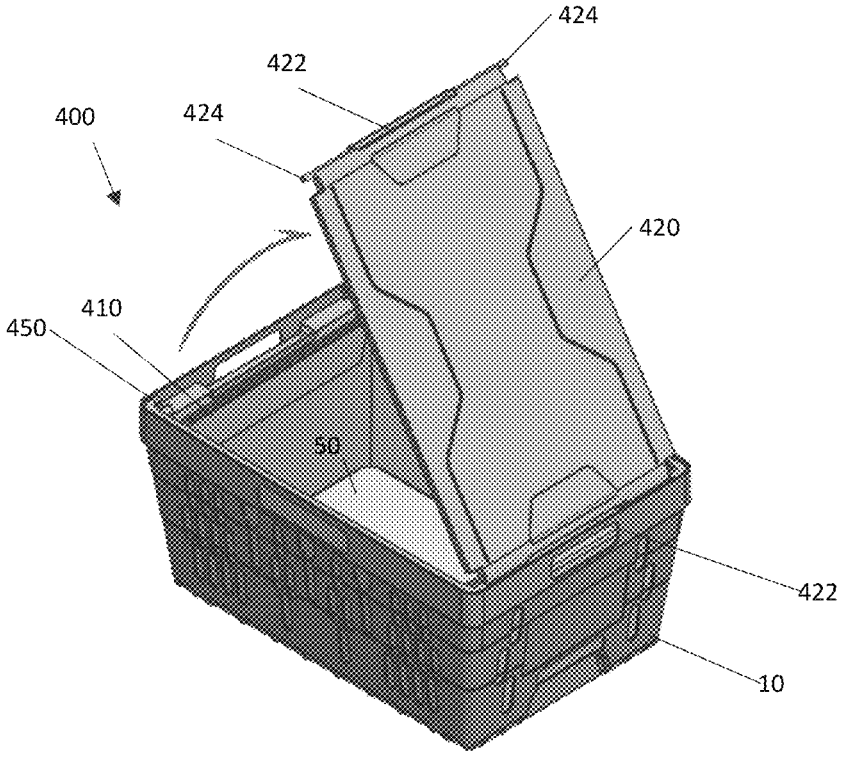
FIG. 17A illustrates the container of FIG. 16 with the lid in a first open position.
Figure 17B:
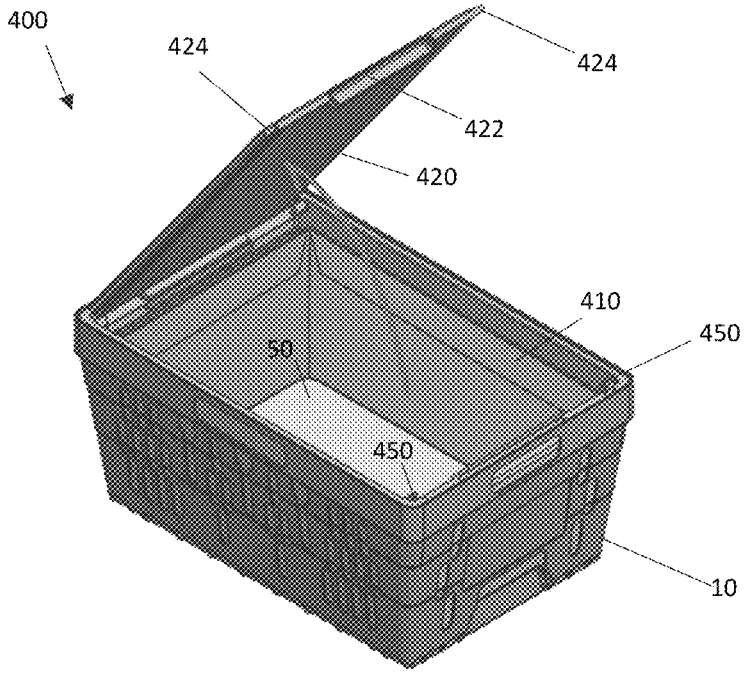
FIG. 17B illustrates the container of FIG. 16 with the lid in a second open position.
Figure 18:
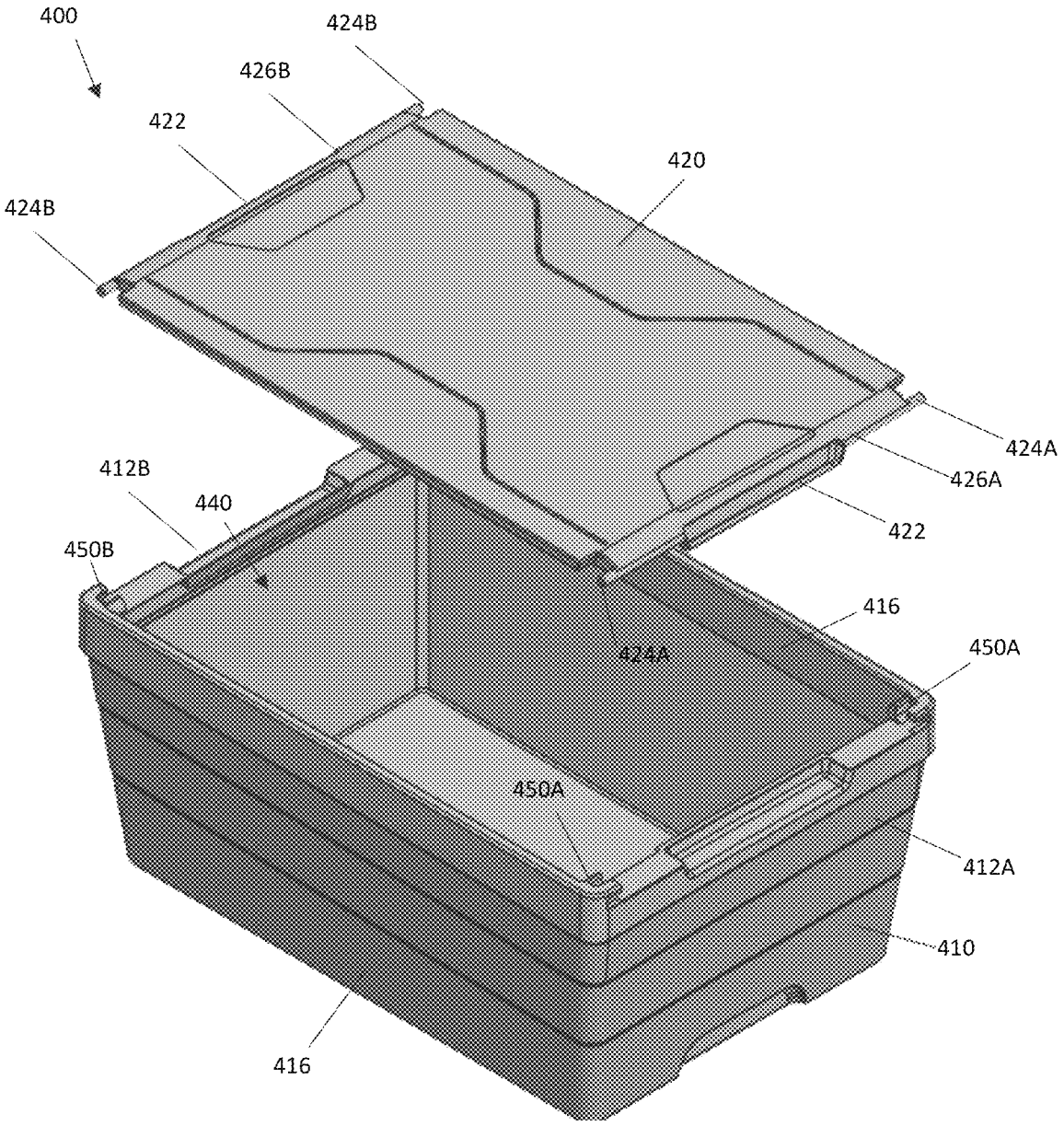
FIG. 18 illustrates an exploded view of the container of FIG. 16.
Figure 19:
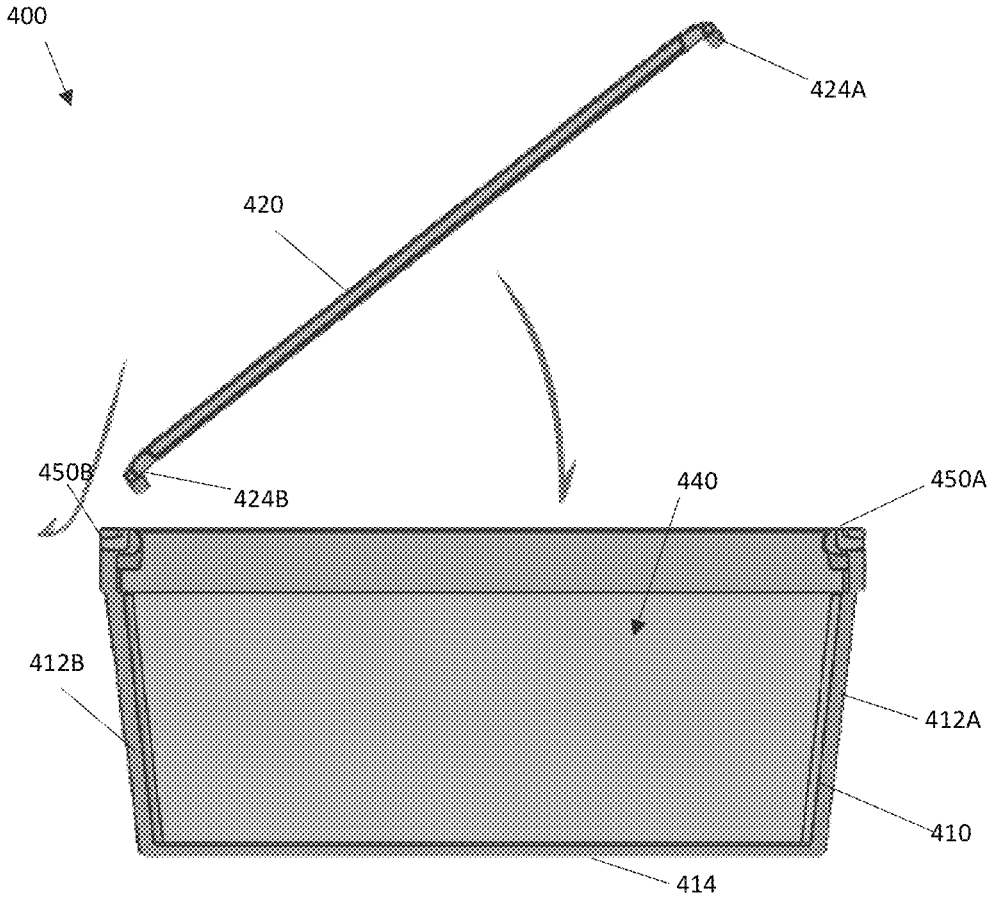
FIG. 19 illustrates an exemplary method of installing the lid on the container of FIG. 16.
Figure 20A:
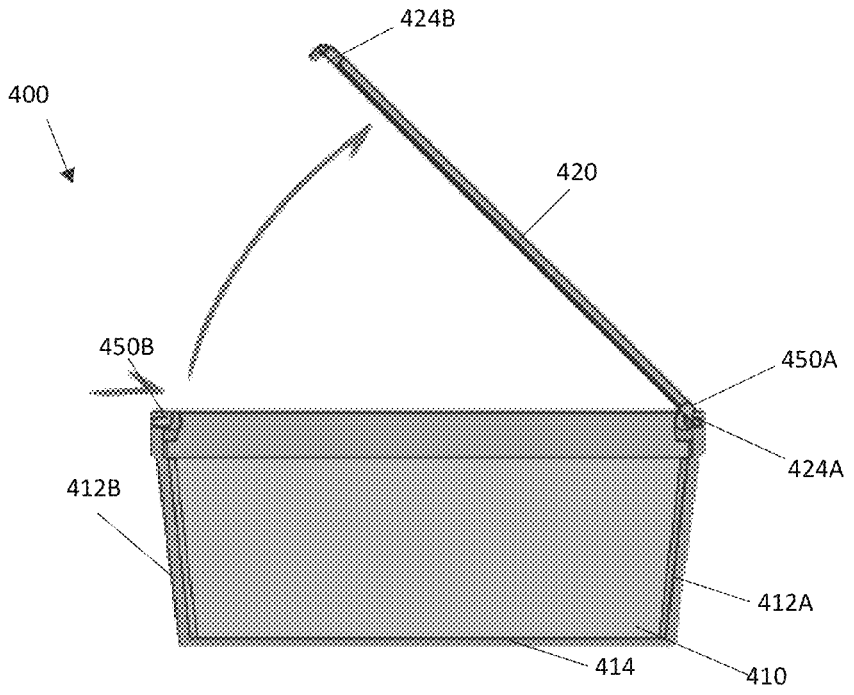
FIG. 20A illustrates opening the lid of the container of FIG. 16 in a first direction.
Figure 20B:
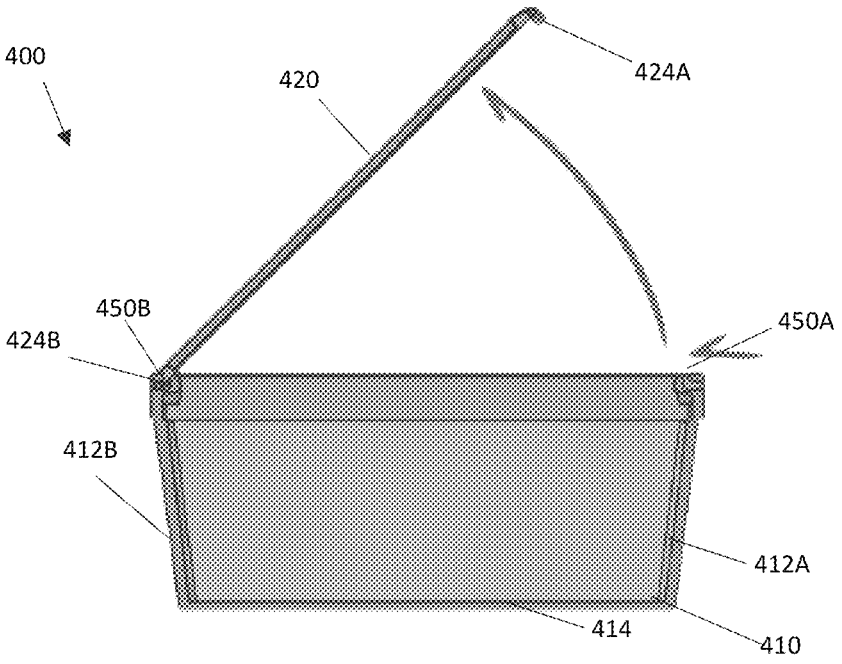
FIG. 20B illustrates opening the lid of the container of FIG. 16 in a second direction.

FIGS. 16-20B illustrate a portable storage container 400. FIG. 16 illustrates container 400 with the lid 420 in a first closed position. FIG. 17A illustrates container 400 with the lid 420 in a second open position. FIG. 17B illustrates container 400 with the lid 420 in a third open position. FIG. 18 illustrates an exploded view of container 400. FIG. 19 illustrates an exemplary method of installing lid 420 onto the main body 410 of container 400. FIG. 20A illustrates a sectional view container 400 with the lid 420 in the second open position. FIG. 20B illustrates a sectional container 400 with the lid 420 in the third open position.

In some exemplary embodiments, portable storage container 400 includes a removable tote 10. In other embodiments, portable storage container 400 does not include a removable tote 10.

Container 400 includes a main body 410 and a removable lid 420. Lid 420 may include one or more handles 422 to assist in opening and closing lid 420.

Main body 410 includes a plurality of sides 412, including first side 412A and second side 412B opposite first side 412. Main body 410 may further include a bottom 414, the sides 412 and bottom 414 defining an interior 440 of container 400. In some exemplary embodiments, a temperature control device 50 may be provided in the interior 440 of container 400.

Lid 420 includes one or more pivot pins 424 allowing lid 420 to pivot or rotate with respect to the main body 410. As illustrated in FIG. 18, lid 420 includes a first pair of pivot pins 424A at a first end 426A of lid 420 and a second pair of pivot pins 424B at a second end 426B of lid 420 opposite first end 426A.

First side wall 412A includes a first receiving track 450A for releasably receiving first pair of pivot pins 424A. First receiving track 450A is illustratively formed from a flexible or resilient material, such as a thermoplastic, to allow first pair of pivot pins 424A to snap into and out of first receiving track 450A.

Second side wall 412B includes a second receiving track 450B for releasably receiving second pair of pivot pins 424A. Second receiving track 450B is illustratively formed from a flexible or resilient material, such as a thermoplastic, to allow second pair of pivot pins 424B to snap into and out of first receiving track 450B.

In some exemplary embodiments, first pair of pivot pins 424A and second pair of pivot pins 424B are the same size, allowing either receiving track 450 to receive either pair of pivot pins 424.

As illustrated in FIG. 16, in the first closed position, the first pair of pivot pins 424A are releasably received within the first receiving track 450A and the second pair of pivot pins 424B are releasably received within the second receiving track 450B. As illustrated in FIGS. 17A and 20A, lid 420 can be opened to a second open position by pulling up on one of the handles 422 to release the second pair of pivot pins 424B from the second receiving track 450B and rotating the first pair of pivot pins 424A within the first receiving track 450A. Alternately, as illustrated in FIGS. 17B and 20B, lid 420 can be opened to a third open position by pulling up on the other of the handles 422 to release the first pair of pivot pins 424A from the first receiving track 450A and rotating the second pair of pivot pins 424B within the second receiving track 450A. In either open position, the handle can be released and the lid 420 drops back into the first closed position (FIG. 16).

As illustrated in FIG. 19, to install lid 420 onto main body 410, one pair of pivot pins 424B are aligned with the corresponding receiving track 450B and snapped into position. The opposite end of the lid 420 is then rotated or pivoted downward into the first closed position (FIG. 16).

Bottom 414, sides 412, and lid 430 of container 400 illustratively include thermal insulation. Exemplary thermal insulation include polyurethane foam, expanded polypropylene foam, closed-cell extruded polystyrene foam, expanded polystyrene foam, polyisocyanurate foam, composite honeycomb materials, and vacuum insulated panels (VIPs). In some exemplary embodiments, bottom 414, sides 412, and lid 420 include foam insulation. In some exemplary embodiments, bottom 414, sides 412, and lid 420 include vacuum insulated panels. In some exemplary embodiments, bottom 414 and sides 412 include foam insulation and lid 420 includes vacuum insulated panels.

In some exemplary embodiments, the foam insulation in one or more of bottom 414, sides 412, and lid 420 has a thickness as little as 0.25", 0.5", 0.75", as great as 1", 1.25", 1.5", or greater, or within any range defined between any two of the foregoing values. In some exemplary embodiments, the foam insulation has a thermal resistance (R-value) per inch of thickness as little as about 3, about 4, about 5, as great as about 6, about 7, about 8, about 9, about 10, or within any range defined between any two of the foregoing values. In some exemplary embodiments, the foam insulation has a total thermal resistance (R-value) as little as about 3, about 4, about 5, as great as about 6, about 7, about 8, about 9, about 10, or within any range defined between any two of the foregoing values.

In some exemplary embodiments, the VIP in one or more of bottom 414, sides 412, and lid 420 has a thickness as little as 0.1", 0.15", 0.2", as great as 0.25", 0.3", 0.35", 0.4", 0.5", or greater, or within any range defined between any two of the foregoing values. In some exemplary embodiments, the VIP has a thermal resistance (R-value) per inch of thickness as little as about 10, about 15, about 20, as great as about 25, about 30, about 35, about 40, about 45, about 50, or greater, or within any range defined between any two of the foregoing values. In some exemplary embodiments, the VIP has a total thermal resistance (R-value) as little as about 3, about 4, about 5, as great as about 6, about 7, about 8, about 9, about 10, or within any range defined between any two of the foregoing values.

Figure 21:
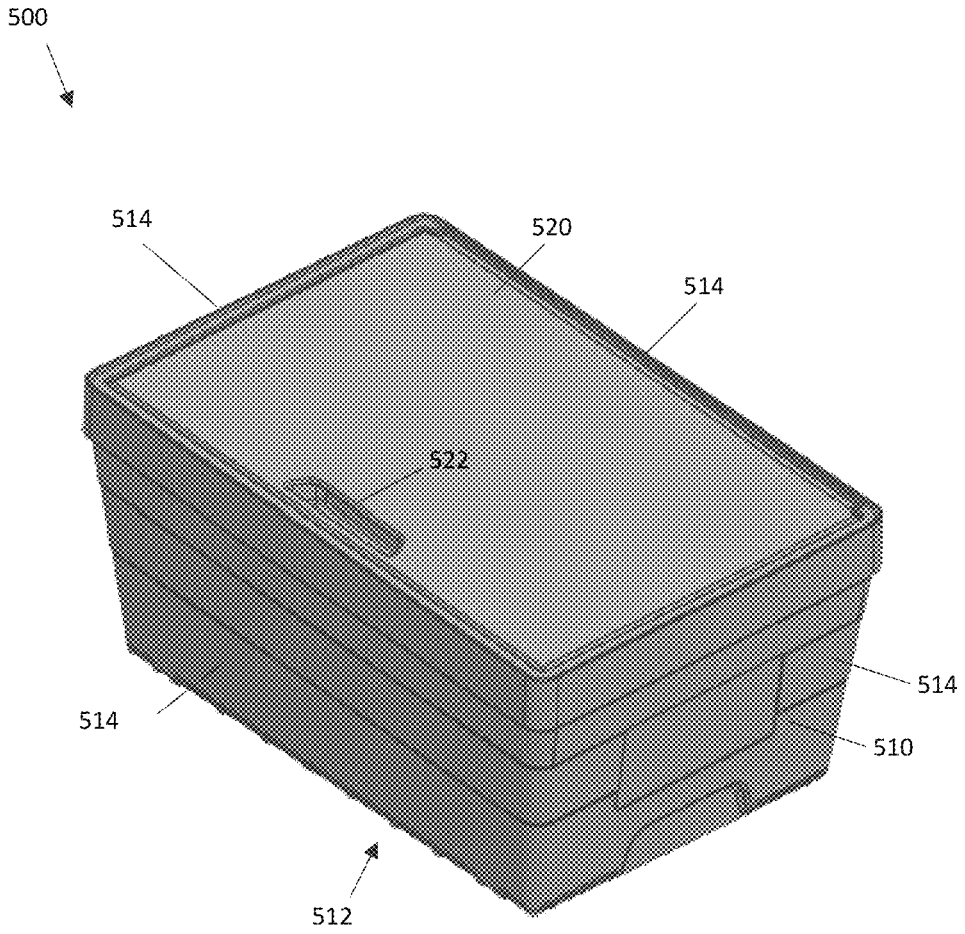
FIG. 21 illustrates a fifth exemplary insulated portable storage container with the lid in a closed position.
Figure 22:
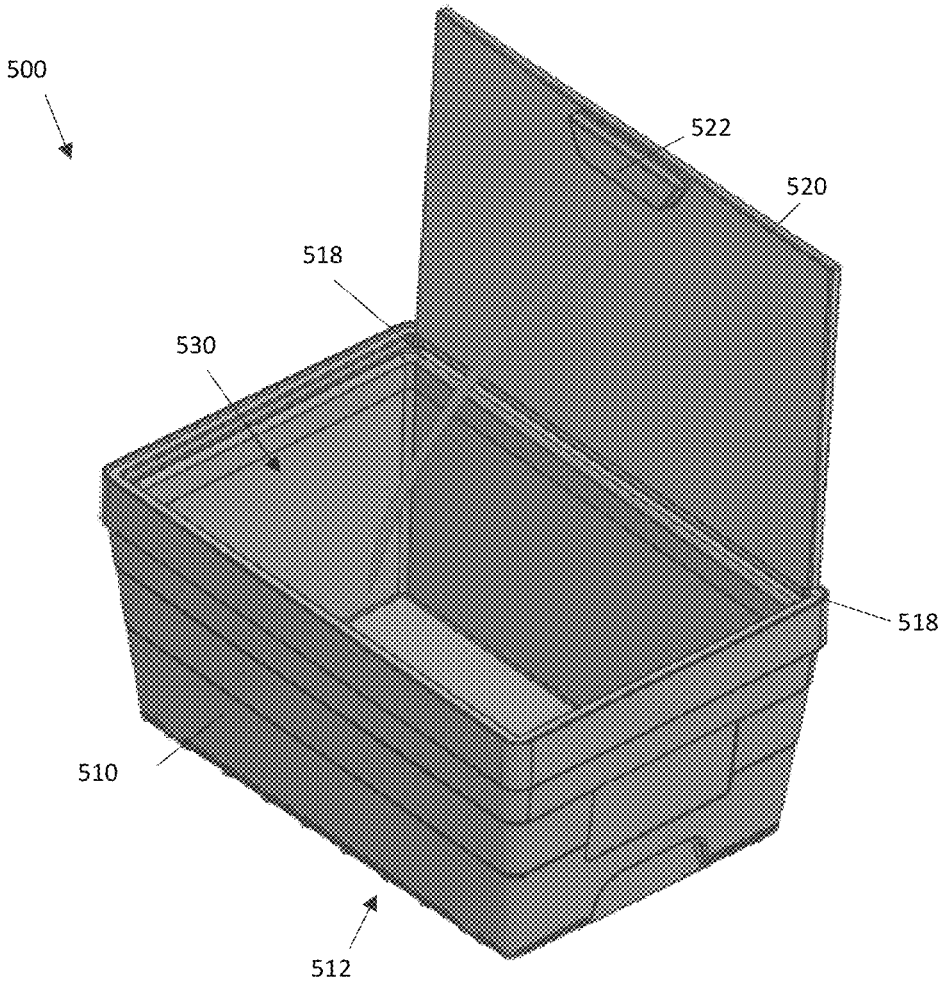
FIG. 22 illustrates the container of FIG. 21 with the lid in an open position.
Figure 23:
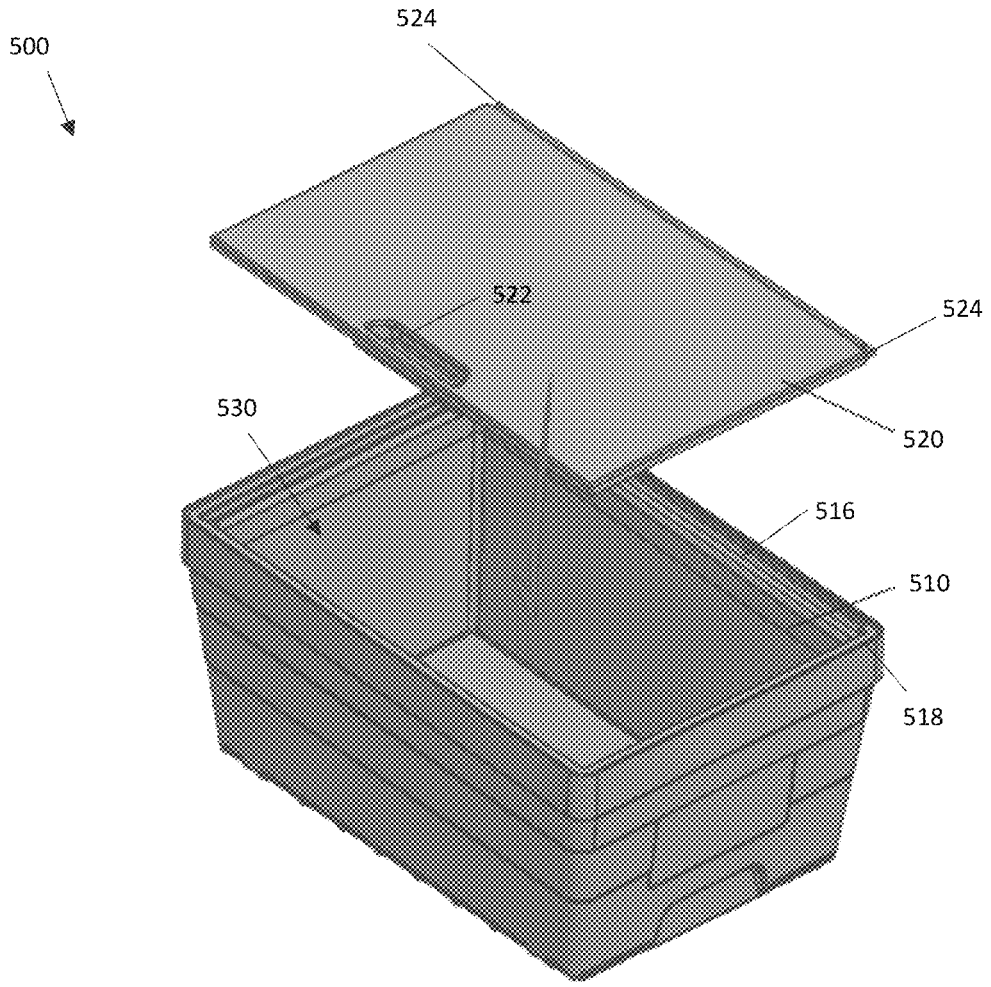
FIG. 23 illustrates an exemplary method of installing the lid on the container of FIG. 21.

FIGS. 21-23 illustrate a portable storage container 500. FIG. 21 illustrates container 500 with the lid 520 in a first closed position. FIG. 22 illustrates container 500 with the lid 520 in a second open position. FIG. 23 illustrates an exemplary method of installing lid 520 onto the main body 510 of container 500.

In some exemplary embodiments, portable storage container 500 includes a removable tote 10. In other embodiments, portable storage container 500 does not include a removable tote 10.

Container 500 includes a main body 510 and a removable lid 520. Main body 510 includes a bottom 512 and one or more sides 514 defining an interior 530 of container 500. In some exemplary embodiments, a temperature control device 50 may be provided in the interior 530 of container 500.

Sides 514 include a recessed edge 516 configured to support the lid 520 when the lid 520 is in the first closed position (FIG. 21). Lid 520 may include one or more handles 522 to assist in opening and closing lid 520.

Lid 520 further includes a pair of pivot pins 524 configured to allow the lid 520 to rotate between the first closed position (FIG. 21) and second open position (FIG. 22). As illustrated in FIG. 23, the pair of pivot pins 524 are configured to snap into corresponding receivers 518 in the upper portion of sides 514 of main body 510. Receivers 518 are illustratively formed from a flexible or resilient material, such as a thermoplastic, to allow the pair of pivot pins 524 to snap into and out the corresponding receivers 518.

Bottom 512, sides 514, and lid 520 of container 500 illustratively include thermal insulation. Exemplary thermal insulation include polyurethane foam, expanded polypropylene foam, closed-cell extruded polystyrene foam, expanded polystyrene foam, polyisocyanurate foam, composite honeycomb materials, and vacuum insulated panels (VIPs). In some exemplary embodiments, bottom 512, sides 514, and lid 520 include foam insulation. In some exemplary embodiments, bottom 512, sides 514, and lid 520 include vacuum insulated panels. In some exemplary embodiments, bottom 512 and sides 514 include foam insulation and lid 520 includes vacuum insulated panels.

In some exemplary embodiments, the foam insulation in one or more of bottom 512, sides 514, and lid 520 has a thickness as little as 0.25", 0.5", 0.75", as great as 1", 1.25", 1.5", or greater, or within any range defined between any two of the foregoing values. In some exemplary embodiments, the foam insulation has a thermal resistance (R-value) per inch of thickness as little as about 3, about 4, about 5, as great as about 6, about 7, about 8, about 9, about 10, or within any range defined between any two of the foregoing values. In some exemplary embodiments, the foam insulation has a total thermal resistance (R-value) as little as about 3, about 4, about 5, as great as about 6, about 7, about 8, about 9, about 10, or within any range defined between any two of the foregoing values.

In some exemplary embodiments, the VIP in one or more of bottom 512, sides 514, and lid 520 has a thickness as little as 0.1", 0.15", 0.2", as great as 0.25", 0.3", 0.35", 0.4", 0.5", or greater, or within any range defined between any two of the foregoing values. In some exemplary embodiments, the VIP has a thermal resistance (R-value) per inch of thickness as little as about 10, about 15, about 20, as great as about 25, about 30, about 35, about 40, about 45, about 50, or greater, or within any range defined between any two of the foregoing values. In some exemplary embodiments, the VIP has a total thermal resistance (R-value) as little as about 3, about 4, about 5, as great as about 6, about 7, about 8, about 9, about 10, or within any range defined between any two of the foregoing values.

Figure 24:
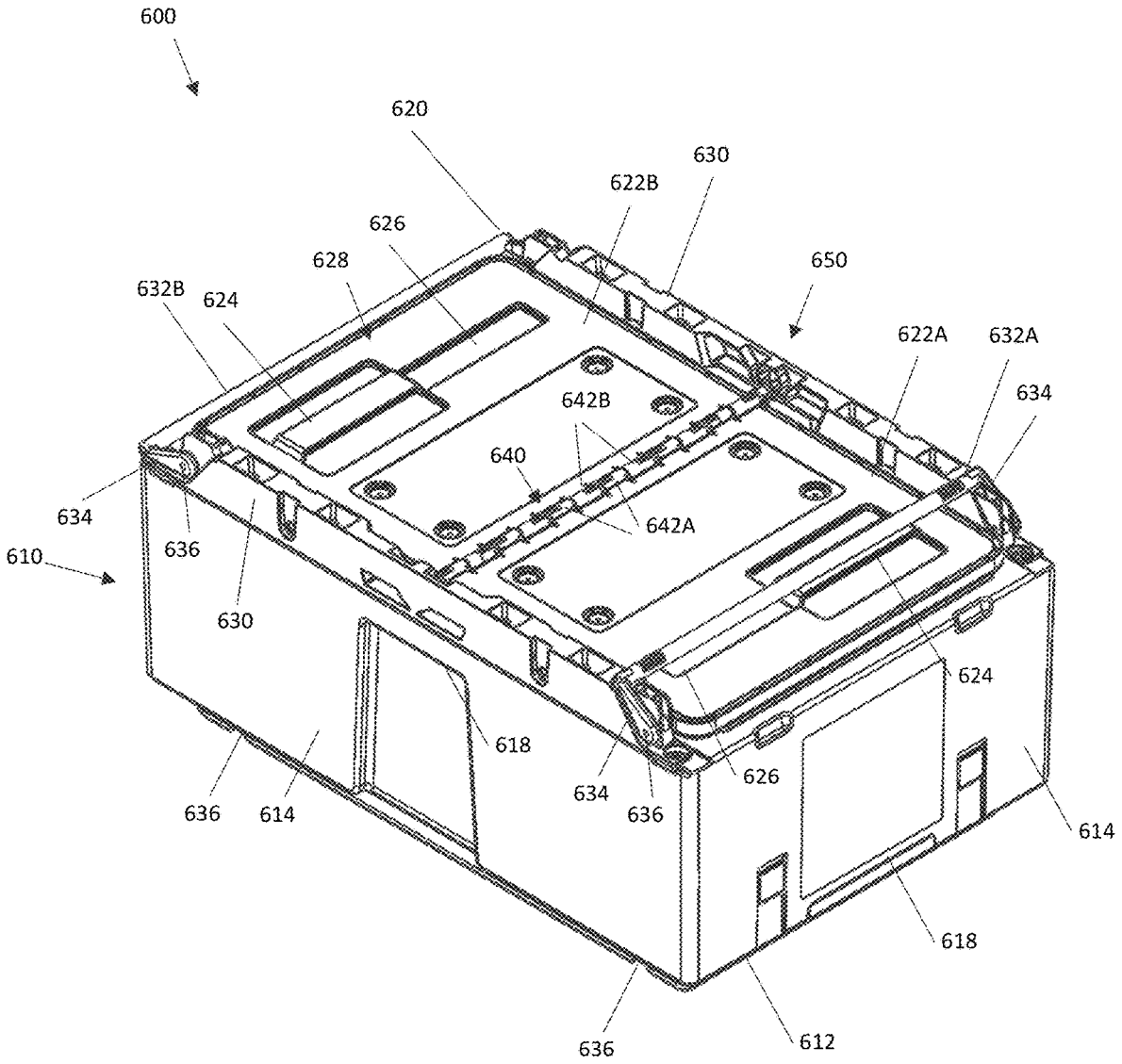
FIG. 24 illustrates a sixth exemplary insulated portable storage container.

FIG. 24 illustrates an exemplary portable storage container 600. Container 600 includes a main body 610 having a bottom 612 and one or more sides 614 extending upwardly from bottom 612. Although container 600 is illustrated as substantially rectangular in cross-section, in other embodiments, container 600 may be any suitable shape, including circular, oval, triangular, or a polygon having five or more sides. In some embodiments, one or more sides 614 include a handle 618 to allow a user to lift container 600.

Container 600 includes upper perimeter section 620 affixed to the upper end of sides 114. In some exemplary embodiments, upper perimeter section 620 is formed from a rigid plastic material and is affixed to the main body 110, such as with an adhesive or suitable fasteners.

Upper perimeter section 620 includes a central aperture covered by first lid panel 622A and second lid panel 622B. Each panel 622 includes a handle 624 and recess 626. The recess 626 on first lid panel 622A is aligned to receive handle 624 of second lid panel 622B and the recess 626 on second lid panel 622B is aligned to receive handle 624 of first lid panel 622A when either panel 622 is moved to an open position in contact with the other panel 622.

In some embodiments, bottom 612, one or more sides 614, and one or more panels 622A, 622B include thermal insulation. Exemplary thermal insulation include polyurethane foam, expanded polypropylene foam, closed-cell extruded polystyrene foam, expanded polystyrene foam, polyisocyanurate foam, composite honeycomb materials, and vacuum insulated panels (VIPs). In some exemplary embodiments, the foam insulation in one or more of bottom 612, one or more sides 614, and one or more panels 622A, 622B has a thickness as little as 0.25", 0.5", 0.75", as great as 1", 1.25", 1.5", or greater, or within any range defined between any two of the foregoing values. In some exemplary embodiments, the foam insulation has a thermal resistance (R-value) per inch of thickness as little as about 3, about 4, about 5, as great as about 6, about 7, about 8, about 9, about 10, or within any range defined between any two of the foregoing values. In some exemplary embodiments, the foam insulation has a total thermal resistance (R-value) as little as about 3, about 4, about 5, as great as about 6, about 7, about 8, about 9, about 10, or within any range defined between any two of the foregoing values. In some exemplary embodiments, the VIP in one or more of bottom 612, one or more sides 614, and one or more panels 622A, 622B has a thickness as little as 0.1", 0.15", 0.2", as great as 0.25", 0.3", 0.35", 0.4", 0.5", or greater, or within any range defined between any two of the foregoing values. In some exemplary embodiments, the VIP has a thermal resistance (R-value) per inch of thickness as little as about 10, about 15, about 20, as great as about 25, about 30, about 35, about 40, about 45, about 50, or greater, or within any range defined between any two of the foregoing values. In some exemplary embodiments, the VIP has a total thermal resistance (R-value) as little as about 3, about 4, about 5, as great as about 6, about 7, about 8, about 9, about 10, or within any range defined between any two of the foregoing values.

Bottom 612, sides 614, and panels 622A, 622B of container 600 define an interior of container 600. In some exemplary embodiments, a temperature control device (not shown) may be provided in the interior of container 600. Exemplary temperature control devices include devices for maintaining a warm or cold temperature within interior of container 600, such as ice packs, dry ice, packages containing freezable liquids such as glycols or eutectic mixtures, and hot water bottles.

Upper perimeter section 620 further includes one or more elevated ridges 630 each extending along the top surface of a corresponding side 614. A first locking bar 632A extends between opposing elevated ridges 630 to maintain first panel 622A in the closed position. A second locking bar 632B extends between opposing elevated ridges 630 to maintain second panel 622B in the closed position. First locking bar 632A is illustrated in the locked position. Second locking bar 632B is illustrated in the open position. Each locking bar 632 includes one or more arms 634 connecting the bar 632 to one of the elevated ridges 630. Each arm 634 is rotatably attached to the corresponding elevated ridge 630 with a pin 636 to allow arm 634 and attached bar 632 to rotate between the open and closed position.

In some embodiments, bottom 612 includes one or more notches 636 to receive a bar 632 of a second container 600, allowing for more stability in stacking container 600.

First panel 622A and second panel 622B are rotatably attached to elevated ridges 630 with a pivot rod 640. In a closed position, the panels 622A, 622B enclose the interior of container 600. First panel 622A and second panel 622B may be rotated about pivot rod 640. FIG. 24 illustrates first panel 622A and second panel 622B in a closed position.

First panel 622A includes a first plurality of knuckles 642A configured to rotatably affix first panel 622A to pivot rod 640. Second panel 622B includes a second plurality of knuckles 642B configured to rotatably affixed second panel 622B to pivot rod 640. As illustrated in FIG. 24, first plurality of knuckles 642A and second plurality of knuckles 642B may be provided in an alternating fashion to substantially cover pivot rod 640.

First panel 622A, second panel 622B, and pivot rod 640 form a removable lid 628. First panel 622A and second panel 622B each have a closed position as illustrated in FIG. 24. In the closed position, first panel 622A and second panel 622B provide a continuous surface enclosing the interior of container 600. If the first locking bar 632A is in the open position, first panel 622A can be rotated about pivot rod 640 to an open position allowing access to the interior of container 600. If the second locking bar 632B is in the open position, second panel 622B can be rotated about pivot rod 640 to an open position allowing access to the interior of container 600. If both locking bars 632A, 632B are in the open position, first panel 622A and second panel 622B can be rotated to a vertical position allowing access to the interior of container 600 and allowing lid 628 to be removed from main body 610 as described below.

If either panel 622 is opened to the vertical position having an angle less than about 90°, that panel 622 will fall back to a closed position. If either panel 622 is opened to an angle greater than about 90°, the panel 622 will fall over to an open position. Accordingly, the first panel 622A and second panel 622B are coplanar when in the closed position and the first panel 622A and second panel 622B are parallel to each other in a first open position in which first panel 622A is positioned on top of second panel 622B, a second open position in which second panel 622B is positioned on top of first panel 622A, and a vertical position.

Figure 25:
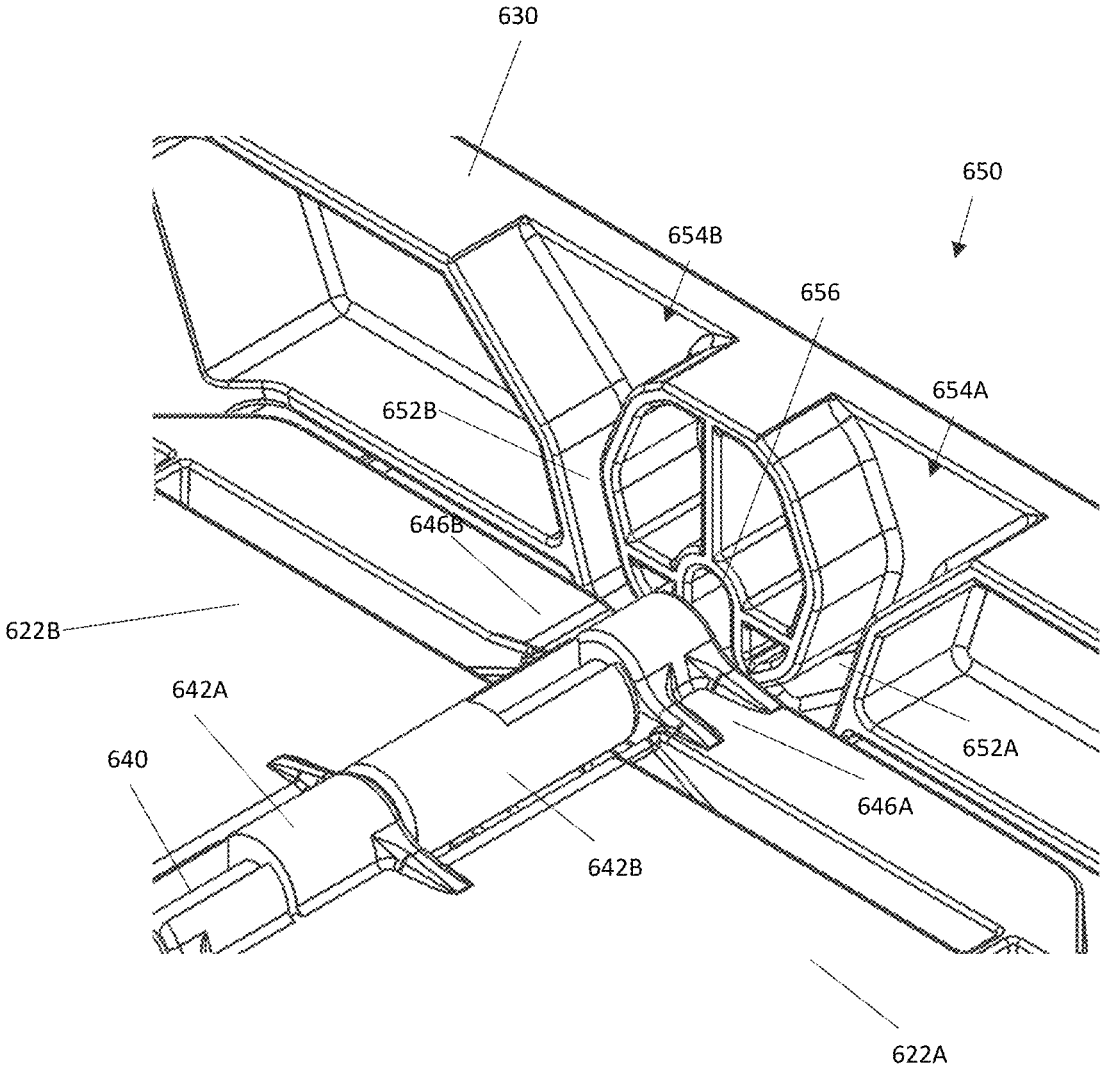
FIG. 25 illustrates a perspective view of the attachment region of the container of FIG. 24.
Figure 26:
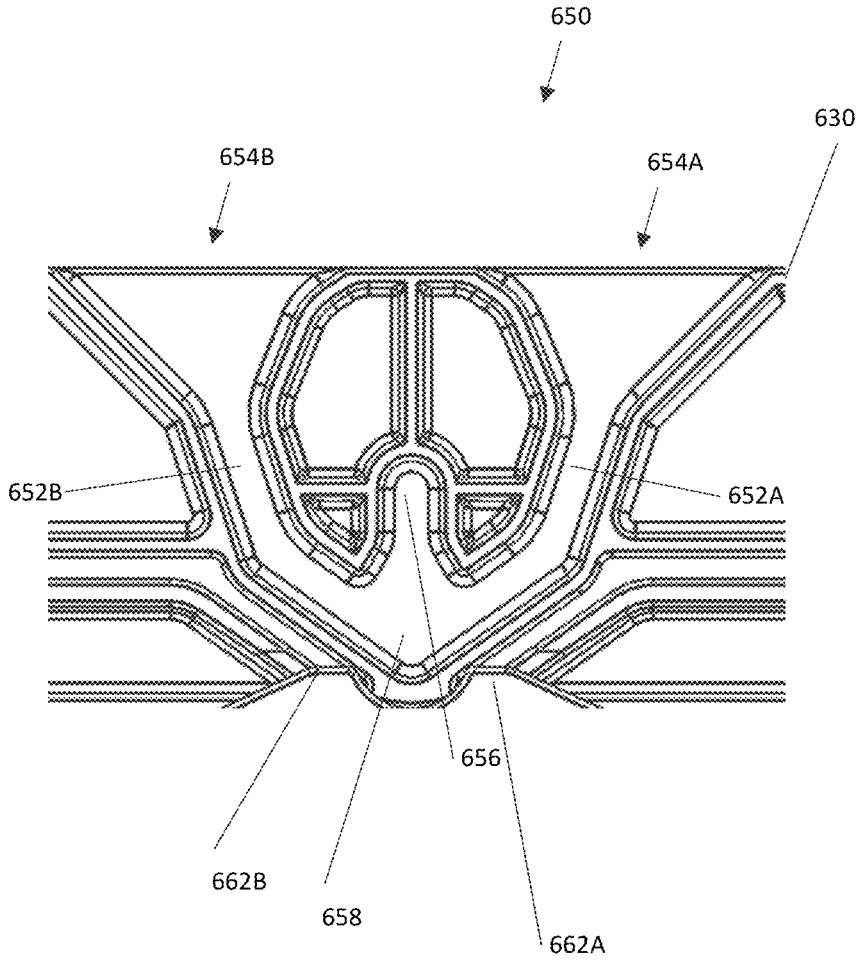
FIG. 26 illustrates the receiver portion of the attachment region of FIG. 25.

Each end of pivot rod 640 is attached to one of the elevated ridges 630 of upper perimeter section 620 with an attachment region 650. Attachment region 650 includes one or more grooves 652 connecting a groove opening 654 to pivot point 656. Pivot point 656 is configured to receive pivot rod 640 to allow first panel 622A and second panel 622B to independently move from the closed position to the open position. In the exemplary embodiment illustrated in FIGS. 25-27, attachment region 650 includes a first groove 652A extending in a curved fashion from first groove opening 654A to pivot point 656 and a second groove 652B extending in a curved fashion from second groove opening 654B to pivot point 656.

Lid 628 is affixed to upper perimeter section 620 by rotating first panel 622A and second panel 622B about pivot rod 640 so that the top surface of first panel 622A is positioned against the top surface of second panel 622B. The ends of pivot rod 640 are next inserted through one of the groove openings 654 into the corresponding channel 652 until they reach the bottom of channel 658 (see FIG. 26).

Figure 27:
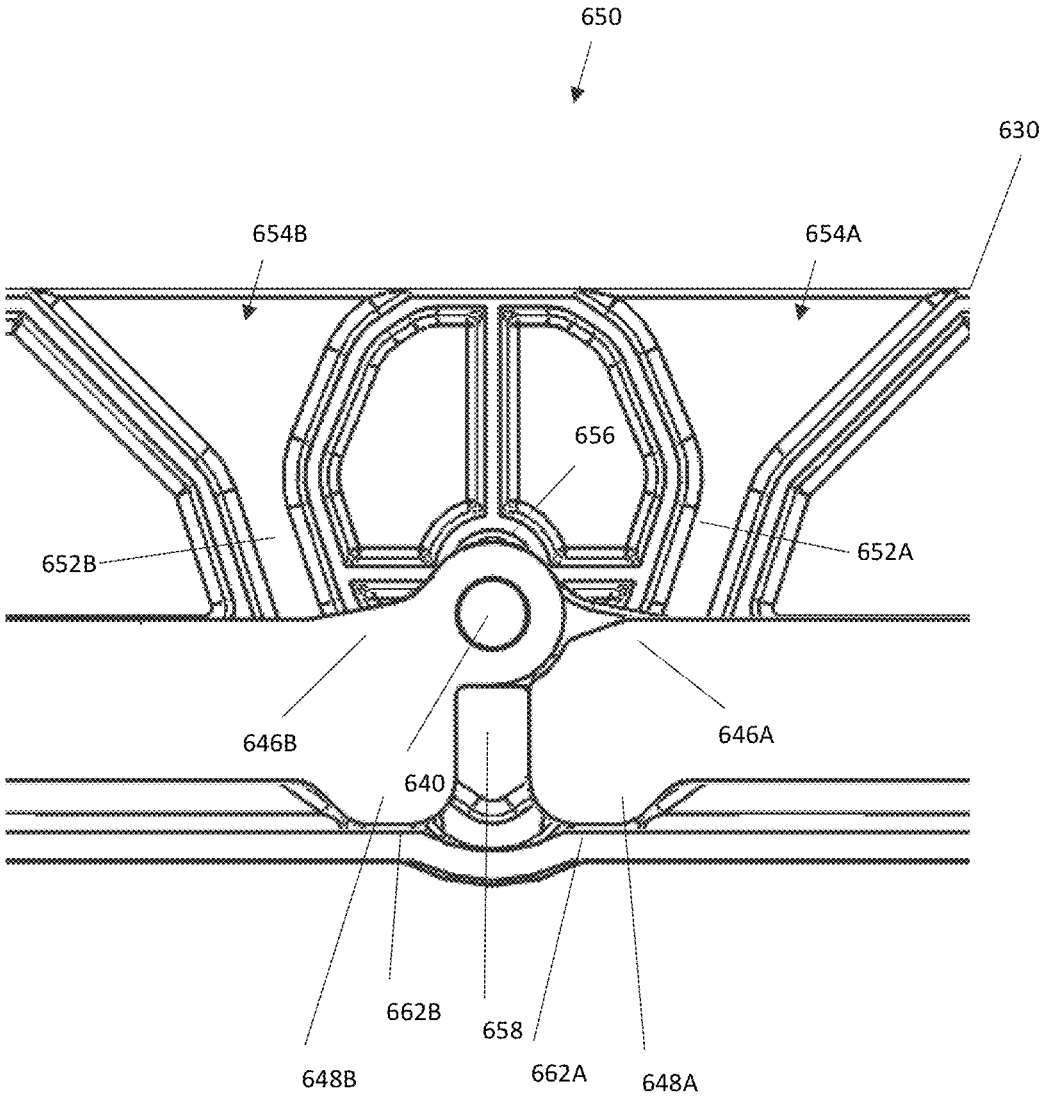
FIG. 27 illustrates the lid connection portion of the attachment region of FIG. 25.

First panel 622A and/or second panel 622B is then moved to the closed position. As illustrated in FIG. 27, the bottom of corresponding ends 646A of first panel 622A each include a projection 648A and the bottom of corresponding ends 646B of second panel 622B each include a projection 648B. As first panel 622A is moved from the open position to the closed position, projection 648A contacts a corresponding portion 662A of upper perimeter section 620. As first panel 622A continues to move to the open position, the contact between projection 648A and portion 662A moves the lid 628 upward and pivot pin 640 upward from the bottom 658 of channel 652A or 652B and into pivot point 656. Similarly, as second panel 622B is moved from the open position to the closed position, projection 648B contacts a corresponding portion 662B of upper perimeter section 620. As second panel 622B continues to move to the open position, the contact between projection 648B and portion 662B moves the lid 628 upward and pivot pin 640 upward from the bottom 658 of channel 652A or 652B and into pivot point 656.

Once pivot pin 640 has been moved into the pivot point 658, lid 628 can no longer be removed as long as at least one of the panels 622A, 622B is in the closed position.

In order to remove lid 628, both first panel 622A and second panel 622B are moved to a vertical orientation. In this orientation, projections 648A, 648B are not in contact with portion 662A, 662B, allowing pivot pin 640 to slide downward into the bottom 658 of the channel, and then removed upwardly through either channel 652A or 6526.

Figure 28:
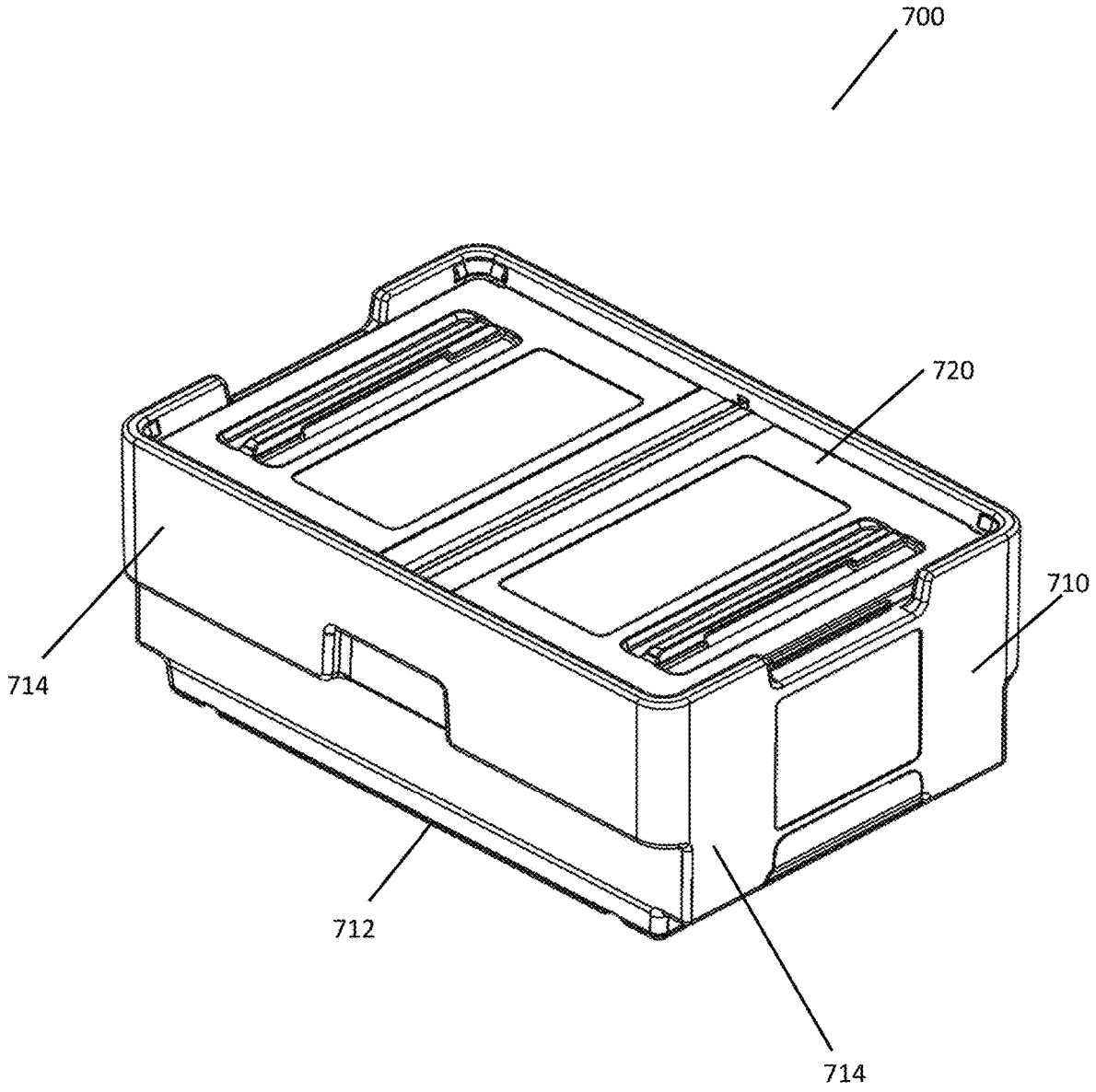
FIG. 28 illustrates a seventh exemplary container.

FIG. 28 illustrates a seventh exemplary insulated portable storage container 700. Container 700 may be an example of any of containers 100-600 and may include any of the elements, features, components, characteristics, and/or functions of any of containers 100-600, in any combination. Container 700 may be a storage container, a shipping container, an insulated container, a portable container, a portable insulated container, or any combination thereof. In some examples, container 700 may be an insulated tote which is used in a store or warehouse for picking and temporary storage of an order until the order is picked up by a customer or shipping company and removed from the tote.

Container 700 includes a main body 710 having a bottom 712 and one or more sides 114 extending upwardly from bottom 112. Although container 700 is illustrated as substantially rectangular in cross-section, in other embodiments, container 700 may be any suitable shape, including circular, oval, triangular, or a polygon having five or more sides. Container 700 includes a lid 720. Lid 720 may be an example of any of lids 120-620 and may include any of the elements, features, components, characteristics, and/or functions of any of lids 120-620, in any combination.

Figure 29:
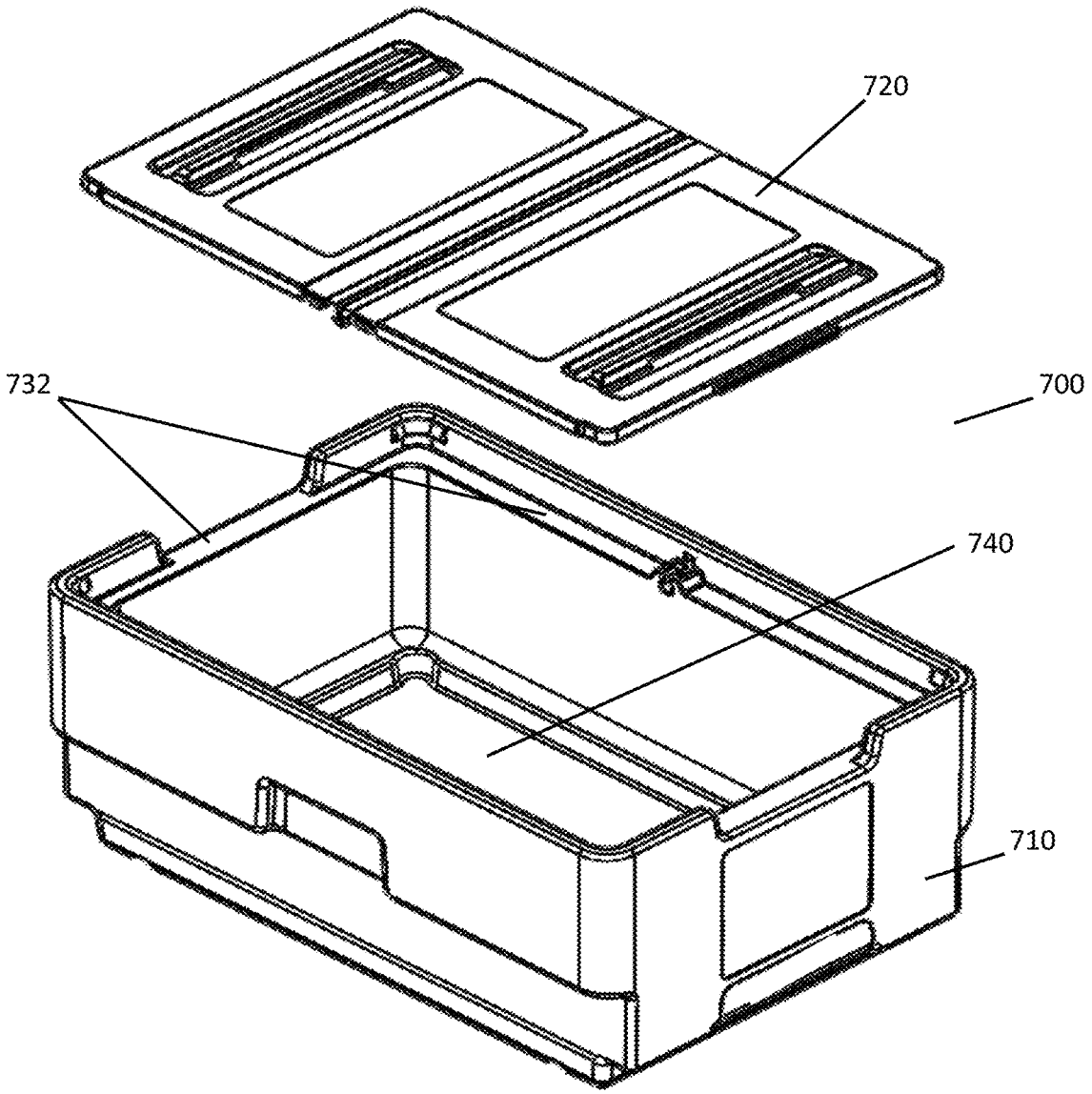
FIG. 29 illustrates a perspective view of the container of FIG. 28 with the lid removed.
Figure 30:
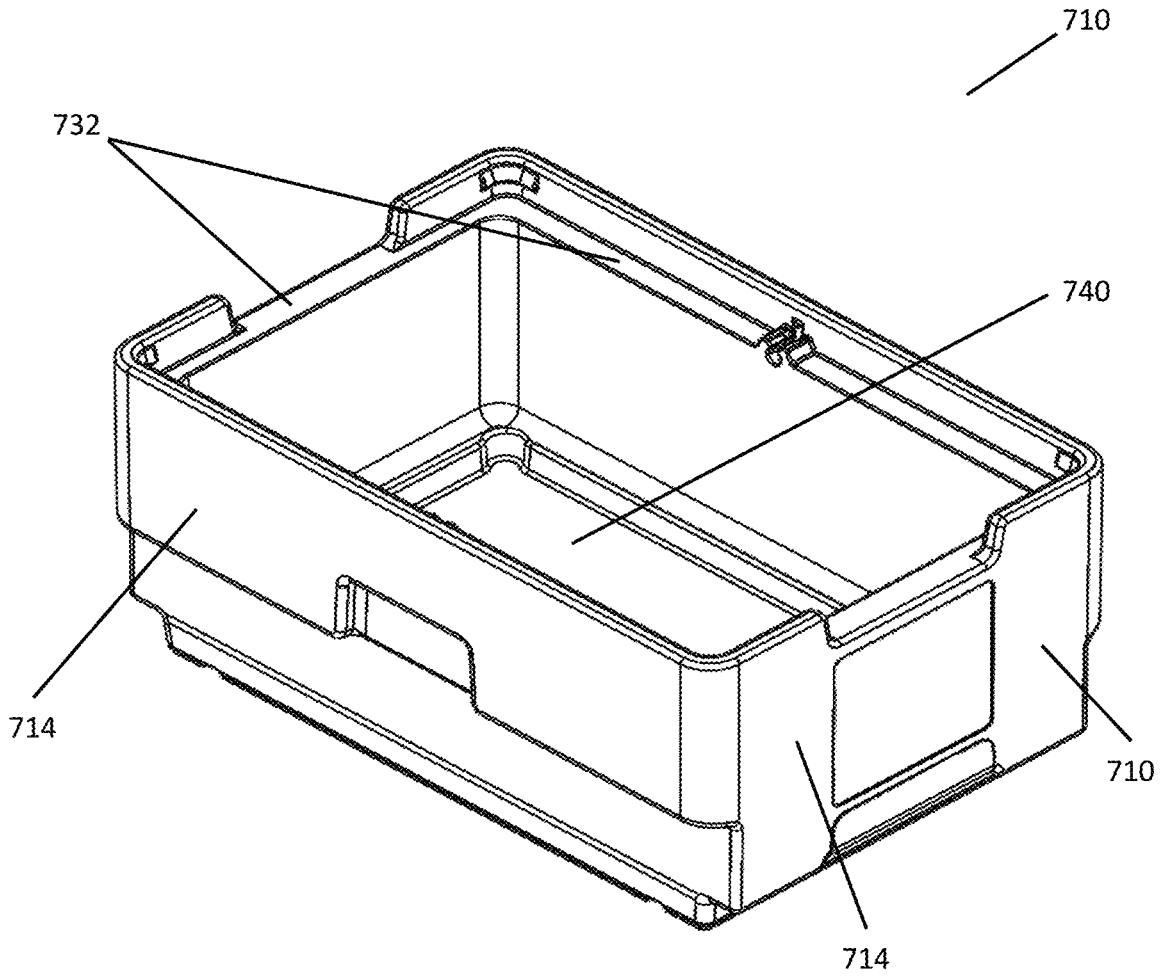
FIG. 30 illustrates the body of the container of FIG. 28.

FIG. 29 illustrates container 700 of FIG. 28 with lid 720 removed from body 710. FIG. 30 illustrates body 710 of container 700 of FIG. 28 without lid 720. Any of bottom 712, sides 714, and lid 720 of container 700 may include thermal insulation. Bottom 712, sides 714, and lid 720 of container 700 may include or be formed from polyurethane foam, expanded polypropylene foam, closed-cell extruded polystyrene foam, expanded polystyrene foam, polyisocyanurate foam, composite honeycomb materials, and vacuum insulated panels (VIPs). In some exemplary embodiments, bottom 712, sides 714, and lid 720 may include foam insulation. In some exemplary embodiments, any of bottom 712, sides 714, and lid 720 may include a durable outer layer, shell, or coating on one or more surfaces. In other examples, any of bottom 712, sides 714, and lid 720 may be formed from a foam material and not have an additional outer layer or shell.

In some exemplary embodiments, the foam insulation in one or more of bottom 712, sides 714, and lid 720 has a thickness as little as 0.25", 0.5", 0.75", as great as 1", 1.25", 1.5", or greater, or within any range defined between any two of the foregoing values. In some exemplary embodiments, the foam insulation has a thermal resistance (R-value) per inch of thickness as little as about 3, about 4, about 5, as great as about 6, about 7, about 8, about 9, about 10, or within any range defined between any two of the foregoing values. In some exemplary embodiments, the foam insulation has a total thermal resistance (R-value) as little as about 3, about 4, about 5, as great as about 6, about 7, about 8, about 9, about 10, or within any range defined between any two of the foregoing values.

Bottom 712, sides 714, and lid 720 of container 700 define an interior 740 of container 100. Interior 740 may also be referred to as a storage volume, storage cavity, storage area, or internal cavity of container 700. Lid 720 removably or reversibly closes interior 740. Lid 720 may rest on one or more ledges 732 of body 710. Ledge 732 may be continuous around the perimeter of body 710 or may have separate portions distributed around the perimeter of container 700. Lid 720 may have an interference or friction fit with one or more top edges of sides 714 such that lid 720 stays in place on ledge 732 until it is intentionally removed by a user. This type of friction fit lid may be suitable for temporary storage or in-store use where a more rugged latching or locking mechanism is not needed. In other examples, body 710 and/or lid 720 may contain latches, clasps, or locks. Beneficially, lid 720 is easily removable for purposes of storage, cleaning, and/or replacement. Body 710 may also be used in a system which contains multiple alternative lids each having different features.

Figure 31:
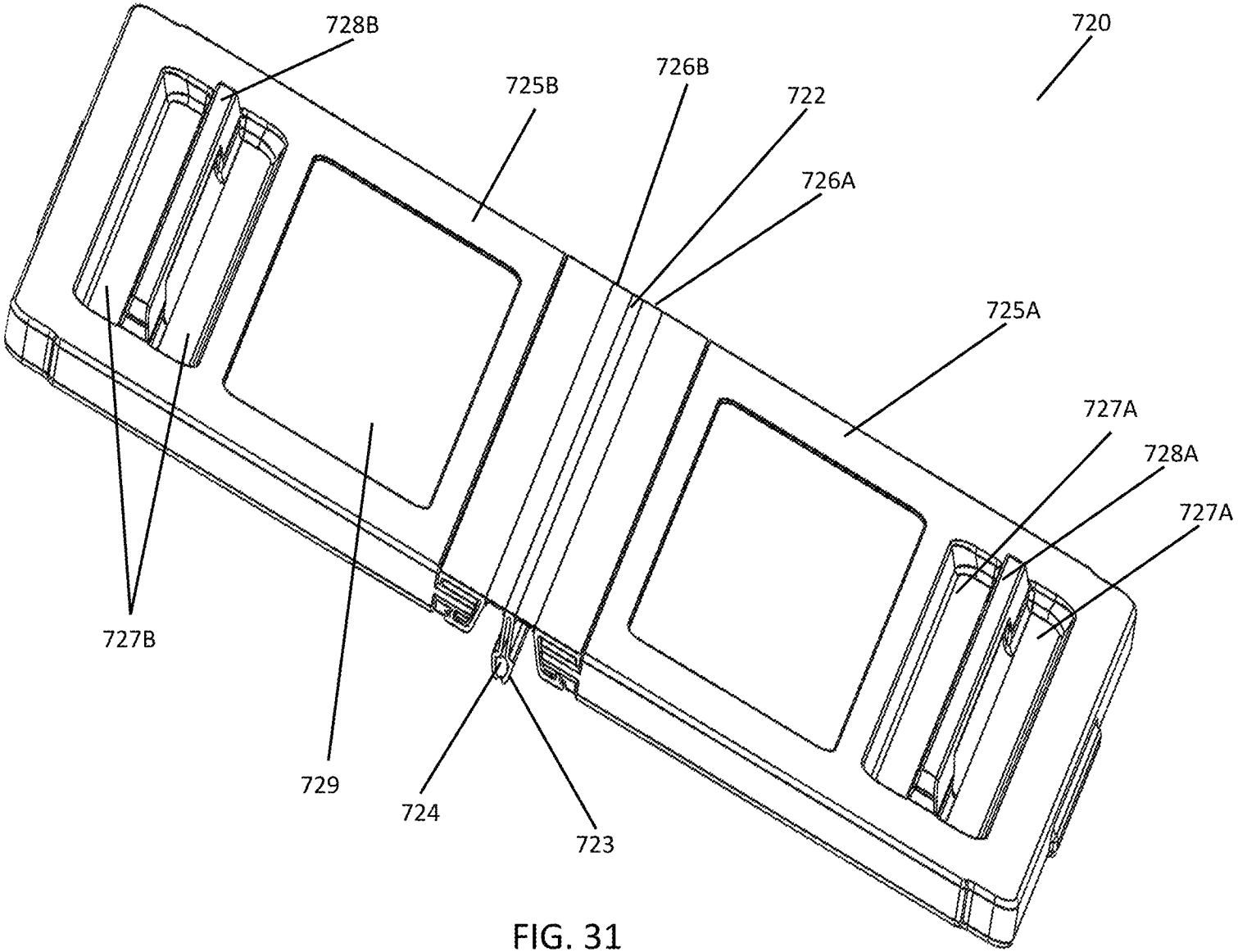
FIG. 31 illustrates the lid of the container of FIG. 28.

FIG. 31 illustrates further detail of lid 720. Lid 720 includes a central lid base 722 with lid members 725A and 725B attached to opposite edges of lid base 722. Lid members 725A and 725B are attached to lid base 722 with hinges 726A and 726B, respectively. Hinges 726A and 726B may be any type of hinging mechanism. In some examples, hinges 726A and 726B may be living hinges formed from a flexible material. Each of lid members 725A and 725B can be independently and separately opened or closed to access interior 740 of container 700. Lid base 722 includes one or more attachment features for removably attaching lid base 722 to body 710.

Figure 32:
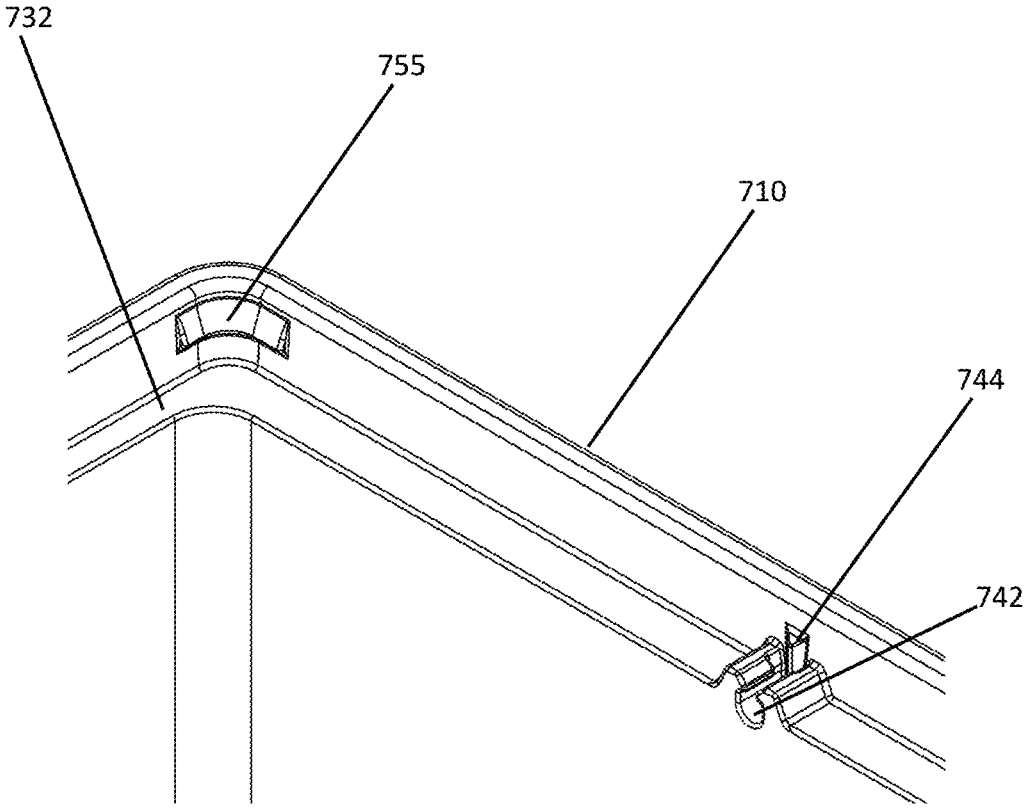
FIG. 32 illustrates a detailed view of a portion of the body of FIG. 30.

In the specific example of FIG. 31, lid base 722 includes a spine 723 which protrudes downward from lid base 722. FIG. 32 illustrates a close up detail view of a portion of body 710 that includes a corresponding attachment feature 728 which engages with spine 723 to removably keep lid base 722, and consequently lid 720, attached to body 710. Attachment feature 728 of body 710 is formed from a resilient or flexible material and has an attachment feature or receptacle, such as receptacle 742, which has an interference or friction fit with spine 723 such that it snaps in and is removably held in place. Body 710 may be formed from a foam material which has inherent resilient characteristics enabling receptacle 742 to provide a snap or friction fit without the use of additional components or materials.

Spine 723 is formed from a flexible material which has a groove, channel, or opening down the center. A rod 724, such as a metal rod, is inserted into the groove or channel to add rigidity and/or stiffness to spine 723 as well as provide a tighter fit with attachment feature 728. Spine 723 extends to the opposing edge of lid base 722 (not visible in FIG. 31) such that it also engages with another attachment feature or receptacle 742 on an opposing side of body 710 from that illustrated in FIG. 32. In this way, lid 720 snaps onto body 710 and is held in place while both lid member 725A and 725B are free to be opened by pivoting or rotating upward in opposite directions. In some examples, rod 724 may extend beyond the ends of spine 723 such that rod 724 extends into receptacle 742 but spine 723 does not.

Body 710 may also include one or more alignment features or guides, such as guide 744, which facilitate the attachment of lid 720 to body 710. Guide 744 may have one or more sloped or tapered surface which help a user get spline 723 or rod 724 started into receptacles 742. Guide 744 may provide visual cues to the user but may also facilitate the insertion process in other ways. For example, the sloped or tapered surface(s) of guide 744 may provider a larger or wider area in which it is easier for the user to get spline 723 or rod 724 started and then narrow down to final installation point which has a tighter fit and/or less clearance.

Body 710 may also include one or more lid detents, such as detent 755. While detent 755 is illustrated in a corner of body 710, detents may also exist at other locations. Detent 755 provides a small recess in which a corner, edge, or protrusion of lid 720, or of another lid, snaps into when it is closed to provide some resistance to it being opened. If body 710 is made from a resilient material one or more of detent 755 tends to keep the lid in place until a sufficient, intentional force is applied to overcome the frictional and/or interference force associated with pulling it out of one or more of detent(s) 755.

While container 700 is primarily discussed with respect to use with lid 720, it should be understood that body 710 may also be used with other types of lids. In one example, body 710 may also be used with a one-piece lid which has no moving parts. In this case, this lid would have to be taken off to access storage space 740. This alternate lid, or even other lids, may also make use of receptacles 742 and/or detent(s) 755 for removably attaching to body 710.

Each of lid member 725A and 725B may include a handle, illustrated as handles 728A and 728B in FIG. 31. Handles 728A and 728B are used to pull or lift open the respective lid member, 725A or 725B. Each of handles 728A and 728B is positioned in a respective handle recess, 727A and 727B. The handle recesses allow the handles to be at least partially recessed into the surface of lid 720 such that the handle have sufficient height to make gripping easy while still reducing the amount that the handles extend above the surface plane of lid 720. The handle recess may be present on one or both sides of the corresponding handle. In some cases, handles 728A and 728B may be fully contained within handle recesses 727A and 727B. In other examples, handles 728A and 728B may be only partially contained within handle recesses 727A and 727B. In either case, the recessed handle causes the handle to protrude less and makes it easier to stack other items, including other instances of container 700, on top of lid 720.

Figure 33:
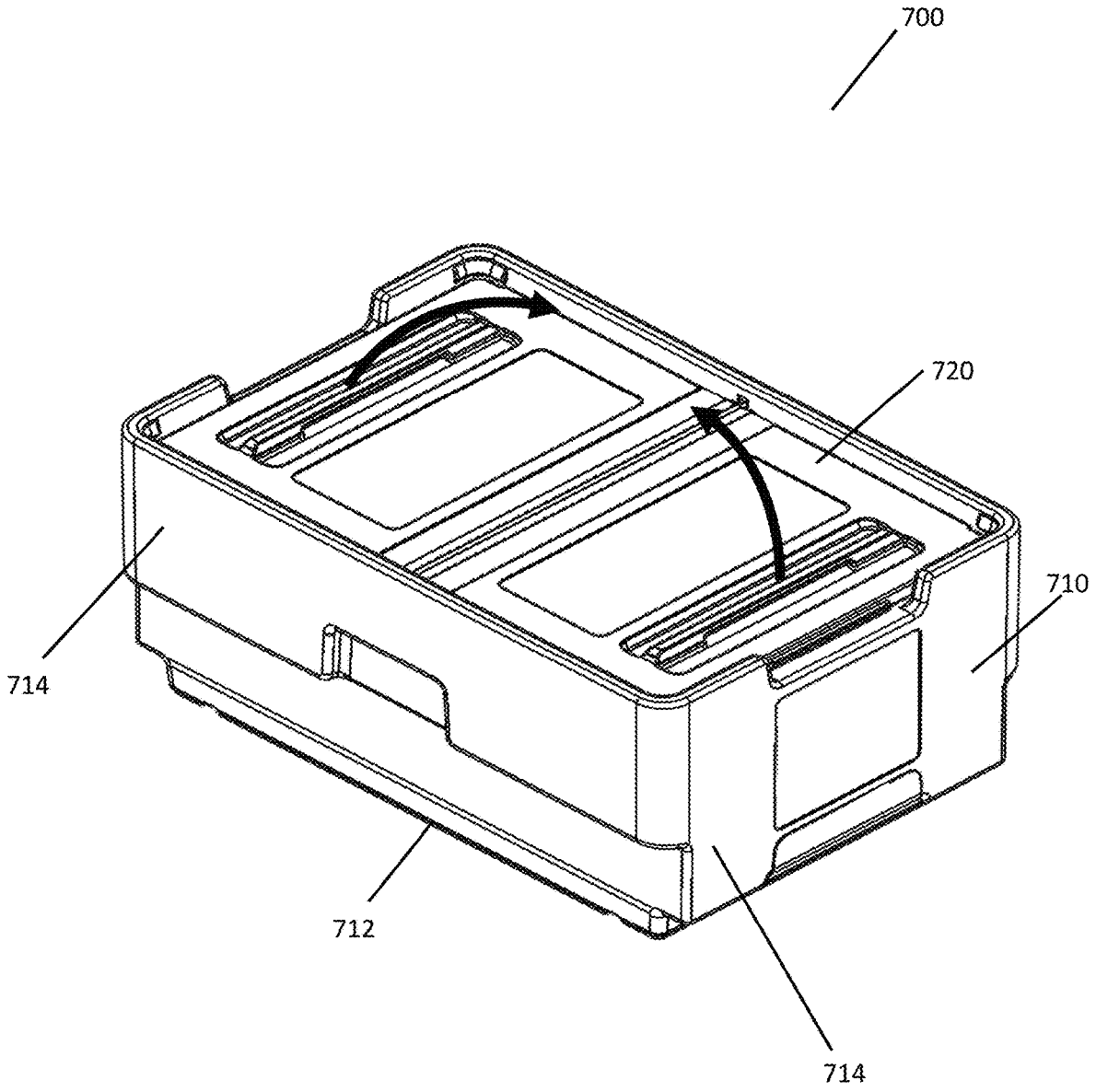
FIG. 33 illustrates the container of FIG. 28 with arrows indicating directions that the lid members open.
Figure 34:
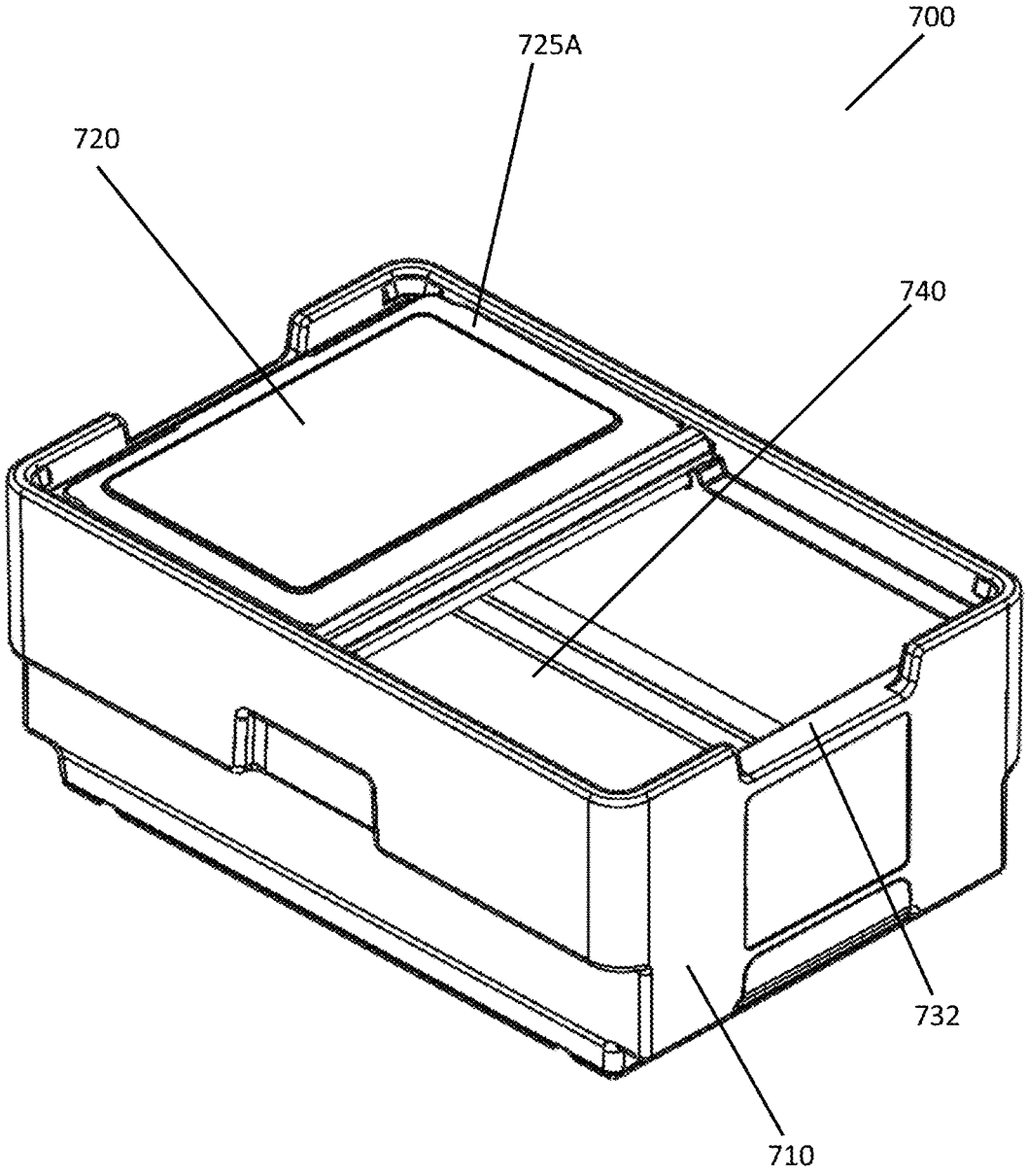
FIG. 34 illustrates the container of FIG. 28 with one of the lid members in an opened position.

As illustrated in FIG. 31, hinges 726A and 726B have different axes. This configuration results in lid members 725A and 725B having different axes of rotation when they are opened and closed. In other words, lid members 725A and 725B do not both pivot from a same axis. Instead, each pivots from its own axis. The two axes are parallel and space apart a specified distance. When one of the lid members is transitioned to the open position, it pivots back over the top of the other lid member. FIG. 33 illustrates container 700 of FIG. 28 with arrows indicating directions that lid members 725A and 725B can pivot open. In FIG. 34, lid member 725A is in the open position and pivoted back over lid member 725B which is still in the closed position (lid member 725B is not visible in FIG. 34 because it is under lid member 725A).

One benefit of the lid members having separate hinges on offset axes is that the lid members are offset from each other when one lid member is in the open position and one lid member is in the closed position (as in FIG. 34). This offset means that even though the lid members may be otherwise identical the handles are not directly aligned when one of the lid members in the open position. The offset between the hinges 726A and 726B is chosen such that handle 728A is at least partially positioned in handle recess 727B when lid member 725A is in the fully opened position. At the same time, handle 728B is at least partially positioned in handle recess 727A. Similarly, the offset between the hinges 726A and 726B is such that handle 728B is at least partially positioned in handle recess 727A when lid member 725B is in the fully opened position. In this way, the usability of lid 720 is improved by having raised handles 728A and 728B that are easier to grab while each lid member lays flat, nearly flat, or substantially flat on the other lid member when one of the lid members is open. In order to allow the lid members to lay completely flat on each other, each of the handle recesses may have a depth which is as large as or larger than a height of the handle above the top surface of the lid member. Bottom 712 of body 710 may also have a one or more recesses for accommodating the handle such that another instance of body 710 is readily stackable on lid 720. The distance between the two hinges corresponds to the offset necessary for the handle of the open lid member to nest in the recess next to the other handle.

Each of lid members 725A and 725B also includes a label region 729 for attaching a label or other documentation. Label region 729 may be recessed in order to reduce the chances of the label being inadvertently removed or torn when other items are placed on or slid across lid 720.

Any of the techniques, improvements, features, functions, or processes described herein may be implemented in the form of a system or a kit. The system or kit may include any combination of the devices, components, elements, and/or modules disclosed herein.

The elements, components, and steps described herein are meant to exemplify some types of possibilities. In no way should the aforementioned examples limit the scope of the invention, as they are only exemplary embodiments.

The phrases "in some embodiments," "in an exemplary embodiment," "in one exemplary embodiment," "in some exemplary embodiments," "according to some embodiments," "in the embodiments shown," "in other embodiments," "in some examples," "in other examples," "in some cases," "in some situations," "in one configuration," "in another configuration," and the like generally mean that the particular technique, feature, structure, or characteristic following the phrase is included in at least one embodiment of the present invention and/or may be included in more than one embodiment of the present invention. In addition, such phrases do not necessarily refer to the same embodiments or to different embodiments.

The foregoing disclosure has been presented for purposes of illustration and description. Other modifications and variations of the disclosed techniques may be possible in view of the above teachings. The embodiments described in the foregoing disclosure were chosen to explain the principles of the concept and its practical application to enable others skilled in the art to best utilize the invention. It is intended that the claims be construed to include other alternative embodiments of the invention, except as limited by the prior art.

What is claimed is:

1. A portable insulated storage container comprising:

a body including a bottom and plurality of sides extending from the bottom, the bottom and the plurality of sides defining an interior storage volume of the portable insulated storage container; and a lid removably attachable to the body for closing the interior storage volume, the lid including a lid base, a first lid member, and a second lid member, wherein the first lid member is hingeably attached to the lid base on a first side of the lid base and the second lid member is hingeably attached to the lid base on a second side of the lid base opposite the first side, wherein the first lid member and the second lid member are each independently movable from a first closed position to a second opened position for allowing access to the interior storage volume when the lid is attached to the body, wherein each of the first lid member and the second lid member includes a handle recess and a handle attached to the lid member in the respective handle recess, and wherein the handle of the first lid member is configured to extend at least partially into the handle recess of the second lid member and the handle of the second lid member is configured to extend at least partially into the handle recess of the first lid member when the first lid member is in the opened position and the second lid member is in the closed position.

2. The portable insulated storage container of claim 1 wherein the handle of the second lid member is configured to extend at least partially into the handle recess of the first lid member when the second lid member is in the opened position and the first lid member is in the closed position.

3. The portable insulated storage container of claim 1 wherein the handle of the first lid member is adjacent the handle of the second lid member when the first lid member is in the opened position and the second lid member is in the closed position.

4. The portable insulated storage container of claim 1 wherein the first lid member is hingeably attached to the lid base with a first hinge and the second lid member is hingeably attached to the lid base with a second hinge, wherein an axis of the first hinge is parallel to an axis of the second hinge.

5. The portable insulated storage container of claim 4 wherein each of the first hinge and the second hinge is a living hinge.

6. The portable insulated storage container of claim 1 wherein each handle is positioned in the associated handle recess such that the handle is accessible in the handle recess from at least two sides.

7. The portable insulated storage container of claim 1 wherein the lid and the body further include corresponding attachment features for removably attaching the lid to the body.

8. The portable insulated storage container of claim 7 wherein the corresponding attachment features include one or more protrusions and one or more receptacles each corresponding to one of the one or more of the protrusions, respectively.

9. The portable insulated storage container of claim 8 wherein the one or more protrusions each have an interference fit with the one or more corresponding receptacles, respectively.

10. The portable insulated storage container of claim 8 wherein the one or more protrusions include a spine that extends from a first edge of the lid base to a second edge of the lid base and the one or more receptacles include two receptacles for receiving the spine positioned on opposing sides of the body.

11. The portable insulated storage container of claim 1 wherein at least a portion of the portable insulated storage container is insulated using a vacuum insulated panel.

12. The portable insulated storage container of claim 1 wherein each of the lid members has an interference fit with a respective portion of the body when the lid is attached to the body and the lid member is in the closed position.

13. A portable storage container system comprising:

a body including a bottom and plurality of sides extending from the bottom, the bottom and the plurality of sides defining an interior storage volume of the portable storage container; and a lid that is removably attachable to the body and configured for closing the interior storage volume of the body, the lid including a lid base, a first lid member, and a second lid member, wherein the first lid member is attached to the lid base with a first hinge and the second lid member is attached to the lid base with a second hinge, wherein the first lid member and the second lid member are each configured to be transitioned from a first closed position to a second opened position for allowing access to the interior storage volume when the lid is attached to the body, wherein the first lid member is configured to pivot in a first direction to transition from the closed position to the open position and the second lid member is configured to pivot in a second direction that is opposite the first direction to transition from the closed position to the open position, wherein each of the first lid member and the second lid member includes a handle recess and a handle positioned in the respective handle recess, and wherein the first lid member is configured to be parallel to the second lid member when the first lid member is in the opened position and the second lid member is in the closed position.

14. The portable storage container system of claim 13 wherein:

the handle of the first lid member is configured to at least partially extend into the handle recess of the second lid member when the first lid member is in the opened position and the second lid member is in the closed position; and the handle of the second lid member is configured to at least partially extend into the handle recess of the first lid member when the second lid member is in the opened position and the first lid member is in the closed position.

15. The portable storage container system of claim 13 wherein the body and the plurality of sides of the body are insulated.

16. The portable storage container system of claim 13 wherein each of the lid members is configured to have an interference fit with respective portions of the body when the lid is attached to the body and the lid members are in the closed positions.

17. The portable storage container system of claim 13 wherein the first hinge and the second hinge are living hinges.

18. The portable storage container system of claim 13 further comprising a second lid that is removably attachable to the body and configured for closing the interior storage volume of the body, wherein the second lid is configured to be used as an alternative to the lid and wherein the second lid does not include any moving components.

19. The portable storage container system of claim 13 wherein another instance of the body is stackable on the lid.

* * * * *